US011505350B2

(12) United States Patent
Palumbo

(10) Patent No.: US 11,505,350 B2
(45) Date of Patent: Nov. 22, 2022

(54) PLANT AND PROCESS FOR VACUUM PACKAGING PRODUCTS

(71) Applicant: Cryovac, LLC, Charlotte, NC (US)

(72) Inventor: Riccardo Palumbo, Arona (IT)

(73) Assignee: Cryovac, LLC, Charlotte, NC (US)

( * ) Notice: Subject to any disclaimer, the term of this patent is extended or adjusted under 35 U.S.C. 154(b) by 73 days.

(21) Appl. No.: 16/771,248

(22) PCT Filed: Dec. 11, 2018

(86) PCT No.: PCT/IB2018/059880
§ 371 (c)(1),
(2) Date: Jun. 10, 2020

(87) PCT Pub. No.: WO2019/116227
PCT Pub. Date: Jun. 20, 2019

(65) Prior Publication Data

US 2021/0171230 A1 Jun. 10, 2021

(30) Foreign Application Priority Data

Dec. 13, 2017 (IT) ..... 102017000143911

(51) Int. Cl.
*B65B 7/16* (2006.01)
*B65B 11/52* (2006.01)
*B65B 31/02* (2006.01)
*B65D 75/30* (2006.01)

(52) U.S. Cl.
CPC ..... *B65B 31/028* (2013.01); *B65B 11/52* (2013.01); *B65B 7/164* (2013.01); *B65D 75/305* (2013.01)

(58) Field of Classification Search
CPC ..... B65B 11/52; B65B 31/028
USPC ..... 53/432, 433, 510, 511
See application file for complete search history.

(56) References Cited

U.S. PATENT DOCUMENTS 2,762,720 A 9/1956 Michel
4,586,320 A * 5/1986 Takai ..... B65B 31/022 53/374.8
4,845,927 A * 7/1989 Rapparini ..... B65B 31/022 53/511
4,987,726 A * 1/1991 Petho ..... B67C 3/04 53/281

(Continued)

FOREIGN PATENT DOCUMENTS

CN 104781146 A 7/2015
EP 0690012 A1 1/1996

(Continued)

*Primary Examiner* — Thanh K Truong
*Assistant Examiner* — Patrick B Fry
(74) *Attorney, Agent, or Firm* — Jon M. Isaacson

(57) ABSTRACT

A plant for vacuum packaging of products includes a plurality of packaging stations, a vacuum pump, a first circuit, an auxiliary pressure device, and a second circuit. The plurality of packaging stations are distinct from each other and configured to separately perform the vacuum packaging of products. The first circuit is configured to put said vacuum pump in fluid communication with said packaging stations. The second circuit is configured to put at least one of said packaging stations in fluid communication with the auxiliary pressure device. The auxiliary pressure device is configured to suction a gas through the second circuit from at least one of said packaging stations.

6 Claims, 9 Drawing Sheets

(56) References Cited

U.S. PATENT DOCUMENTS

| | | | | | |
|---|---|---|---|---|---|
| 5,080,146 | A * | 1/1992 | Arasteh | E06B 3/6775 | 141/243 |
| 5,125,217 | A * | 6/1992 | Fukuda | B65B 9/20 | 198/689.1 |
| 5,155,969 | A * | 10/1992 | Kuethe | B65B 31/028 | 53/329.4 |
| 6,623,821 | B1 | 9/2003 | Kendig | | |
| 7,331,161 | B2 * | 2/2008 | Buchko | B65B 31/022 | 53/432 |
| 7,341,078 | B1 * | 3/2008 | Xia | B65B 31/025 | 141/237 |
| 7,409,811 | B2 * | 8/2008 | Buchko | B65B 31/022 | 137/627.5 |
| 7,803,416 | B2 | 9/2010 | Roveda et al. | | |
| 10,569,915 | B2 * | 2/2020 | Zucchini | B65B 31/02 | |
| 2016/0185473 | A1 * | 6/2016 | Zucchini | F04B 25/00 | 417/53 |

FOREIGN PATENT DOCUMENTS

| | | | |
|---|---|---|---|
| EP | 1529797 | A1 | 5/2005 |
| EP | 2905233 | A1 | 8/2015 |
| EP | 2907759 | A1 | 8/2015 |
| EP | 3293124 | A1 | 3/2018 |
| WO | 9954398 | A1 | 10/1999 |
| WO | 2007093495 | A1 | 8/2007 |
| WO | 2014060507 | A1 | 4/2014 |
| WO | 2014166940 | A1 | 10/2014 |
| WO | 2017149073 | A1 | 9/2017 |

* cited by examiner

1

PLANT AND PROCESS FOR VACUUM PACKAGING PRODUCTS

FIELD OF THE INVENTION

The present invention relates to a vacuum packaging plant and process of products, for example food products. In particular, the invention relates to a plant and a related process for making packages, for example using supports or trays, intended to house at least one product, and at least one plastic film, intended to mate with the support or tray in order to seal the product in a package.

PRIOR ART

Apparatus and related methods for vacuum packaging products are known in the field of packaging. Among the packaging processes, processes and apparatuses that make vacuum packages with plastic films for sealing foods such as meat and fish to be frozen, cheese, treated meat, ready meals and similar foods are known in the food packaging field. In particular, the vacuum packaging process—also termed vacuum skin packaging (VSP)—is essentially a thermoforming process which provides for arranging a product (food) within or above a rigid or semi-rigid support, for example defined by a flat tray, or by a tub or by a cup. The support and the related product are placed inside a vacuum chamber. Inside the chamber, a thermoplastic film is sealed to an upper edge of the support; thereafter, the air present in the package is extracted in such a way that the thermoplastic film can adhere to the product placed inside the support.

Sophisticated, large-sized automated apparatuses have been conceived for automatically transferring a plurality of supports in a single packaging station where a plastic film portion is attached to the supports on which the products have been loaded, so as to efficiently and rapidly obtain a certain number of packaged products; the station is configured for simultaneously forming a plurality of vacuum packages in a packaging cycle. For example, such type of known apparatuses and processes is described in the following patent applications: WO 2014/060507 A1, WO 2014/166940 A1, WO 2017/149073 A1 EP 2 905 233 A1 EP 2 907 759 A1. Although the solutions described in the aforementioned patent applications allow forming high quality packaged products and allow high productivity, these are not, however, free from drawbacks.

The apparatuses currently known exhibit in fact a single high power gas suction system capable of simultaneously forming a plurality of vacuum packages; however, these suction systems are very expensive, excessively bulky and require high energy consumption. It should also be noted that such packaging apparatuses generally exhibit a low flexibility of use as they cannot be easily adapted to small production batches and to the packaging of products on supports of different geometries.

OBJECT OF THE INVENTION

The object of the present invention is to substantially solve the drawbacks and/or limitations of the above prior art.

A first object of the present invention is to provide a quick and highly flexible vacuum packaging plant and process which can therefore reduce production costs to a minimum. It is also an object of the present invention to provide a packaging plant which can be manufactured with modest investment but which at the same time exhibits an excellent production speed of the vacuum packages. A further object of the present invention is to provide a vacuum packaging plant and process capable of efficiently removing an adequate amount of air from the packages. Another object of the present invention is to provide a packaging plant and process capable of operating safely and in particular of achieving the object of removing air without compromising the aesthetic of the final packaged product.

These and yet other objects, which will become more apparent from the following description, are substantially achieved by a packaging plant and process according to what is expressed in one or more of the accompanying claims and/or the following aspects, taken alone or in any combination with each other or in combination with any one of the appended claims and/or in combination with any of the other aspects or features described below.

SUMMARY

In a 1st aspect, a plant (100) for vacuum packaging products (P) is provided, comprising:

- a plurality of packaging stations (1) distinct from each other, and configured for separately performing the vacuum packaging of products (P);
- a vacuum pump (50);
- a first circuit (11) configured for putting in fluid communication said vacuum pump (50) with said packaging stations (1);
- at least one pressure auxiliary device (51);
- at least one second circuit (12) configured for putting in fluid communication at least one of said packaging stations (1) with the at least one auxiliary pressure device (51);

wherein the auxiliary pressure device (51) is configured for suctioning a gas through the second circuit (12), from at least one of said packaging stations (1).

In a 2nd aspect according to the 1st aspect, the plant comprises at least a third fluid circuit (13) configured for putting in fluid communication the vacuum pump (50) with at least one pressure auxiliary device (51).

In a 3rd aspect according to any one of the preceding aspects, the first circuit (11) comprises:

- a primary line (11*a*) in common to the plurality of packaging stations (1);
- a plurality of secondary lines (11*b*), each of them connects the primary line (11*a*) of the first circuit (11) to a respective packaging station (1).

In a 4th aspect according to any one of the preceding aspects, the second circuit (12) comprises:

- a primary line (12*a*) in common to the plurality of packaging stations (1);
- a plurality of secondary lines (12*b*) each of them connects the primary line (12*a*) of the second circuit (12) to a respective packaging station (1).

In a 5th aspect according to the preceding aspect, the third circuit (13) is configured for putting in fluid communication the primary line (11*a*) of the first circuit (11) with the primary line (12*a*) of the second circuit.

In a 6th aspect according to the 4th or 5th aspect, the secondary line (11*b*) of the first circuit (11) is parallel connected to the secondary line (12*b*) of the second circuit (12).

In a 7th aspect according to any one of the preceding claims, wherein each of said first and second circuits (11, 12) comprises a plurality of control valves (20), each configured for defining, independently from each other, at least one between:

a passage condition wherein the control valve (20) enables the fluid to pass;

a closure condition wherein the control valve (20) interdicts the passage of the fluid.

In an 8th aspect according to any one of the aspects from the 3rd to the 7th, each secondary line (11*b*) of the first circuit (11) comprises at least one control valve (20) configured for enabling or interdicting the fluid communication between the primary line (11*a*) of the first circuit (1) and the respective packaging station (1).

In a 9th aspect according to any one of the aspects from the 4th to the 8th, each secondary line (12*b*) of the second circuit (12) comprises at least one control valve (20) configured for enabling or interdicting the fluid communication between the primary line (12*a*) of the second circuit (12) and the respective packaging station (1).

In a 10th aspect according to any one of the preceding aspects, the auxiliary pressure device (51) comprises at least one selected from the group of: a vacuum pump; a reservoir configured for housing a fluid having a pressure lower than an atmospheric pressure measured at 20° C.; a section of the second circuit (12) itself.

In an 11th aspect according to any one of the preceding aspects, wherein each of the packaging stations (1) exhibits:

at least one upper tool (2);

at least one lower tool (3);

said upper and lower tools (2, 3) being configured for defining:

at least one distal position wherein the upper and lower tools (2, 3) are distanced from each other in order to enable to insert or remove:

at least one support (40) supporting at least one product;

at least one closing film (41);

at least one approached position wherein the upper and lower tools (2, 3) are engaged with each other for defining a fluid-tight inner chamber (4) adapted to house, wherein in the approached position, the upper and lower tools (2, 3) are configured for engaging the closing film (41) with the support for defining a package (40*a*) for the product (P).

In a 12th aspect according to the preceding aspect, the upper tool (2) of the packaging station (1) comprises a heating system (18) adapted to heat at least part of the upper tool (2) itself.

In a 13th aspect according to the preceding aspect, the heating system (18) is configured for heating at least one lower surface of the upper tool (2) at least partially facing the lower tool (3).

In a 14th aspect according to the 12th or 13th aspect, the heating system (18) is configured for heating at least one lower surface of the upper tool (2) defining at least part of said inner chamber (4).

In a 15th aspect according to the 13th or 14th aspect, said lower surface of the upper tool (2) is configured, at least in the approached position or before said approached position, for contacting at least a part of the closing film (41).

In a 16th aspect according to any one of the aspects from the 11th to the 15th, the upper and lower tools (2, 3) of each packaging station (1) are connected to the primary line (11*a*) of the first circuit (11) by means of a respective secondary line (11*b*) of the first circuit (11).

In a 17th aspect according to any one of the aspects from the 3rd to the 16th, wherein each secondary line (11*b*) of the first circuit (11) comprises:

a first branch connecting the upper tool (2) to the primary line (11*a*) of the first circuit (11), and a second branch, distinct from the first branch, connecting the lower tool to the primary line (11*a*) of the first circuit (11).

In an 18th aspect according to the preceding aspect, each of said first and second branches comprises a respective control valve (20) configured for enabling or interdicting the fluid communication between the primary line (11*a*) of the first circuit (11) and the respective lower or upper tool.

In a 19th aspect according to any one of the aspects from the 11th to the 18th, the upper and lower tools (2, 3) of each packaging station (1) are connected to the primary line (12*a*) of the second circuit (12) by means of at least one secondary line (12*b*) of the second circuit (12).

In a 20th aspect according to any one of the aspects from the 11th to the 19th, wherein each secondary line (12*b*) of the second circuit (12) comprises at least one branch connecting the upper tool (2) to the primary line (12*a*) of the second circuit (12).

In a 21st aspect according to any one of the aspects from the 11th to the 20th, each secondary line (12*b*) of the second circuit (12) comprises:

a first branch connecting the upper tool (2) to the primary line (12*a*) of the second circuit (12), and optionally a second branch, distinct from the first branch, connecting the lower tool to the primary line (12*a*) of the second circuit (12).

In a 22nd aspect according to the preceding aspect, wherein each of said first and second branches of each secondary line (12*b*) of the second circuit (12) comprises a respective control valve (20) configured for enabling or interdicting the fluid communication between said primary line (12*a*) of the second circuit (12) and the respective lower or upper tool.

In a 23rd aspect according to any one of the preceding aspects, each of said packaging stations (1) comprises at least one respective discharge line (14) of the pressure configured for putting in fluid communication an inner volume of said packaging station with the external environment.

In a 24th aspect according to the preceding aspect, the discharge line (14) of the pressure is configured for putting in fluid communication the inner chamber (4), defined by the upper and lower tool (2, 3) in the approached position, with the external environment.

In a 25th aspect according to the 23rd or 24th aspect, said discharge line (14) comprises a discharge conduit and at least one control valve (20) configured for controlling the passage of fluid through said discharge conduit.

In a 26th aspect according to any one of the aspects from the 11th to the 25th, wherein each packaging station (1) of said plurality comprises at least one heat-sealing system configured for constraining the closing film (41) to the support during the approached position of the lower and upper tools.

In a 27th aspect according to any one of the preceding aspects, the vacuum pump (50) is configured for defining in each of said packaging stations (1) a pressure lower than an atmospheric pressure measured at 20° C.

In a 28th aspect according to any one of the preceding aspects, the vacuum pump (50) is configured for defining at the inner chamber (4) of each of said packaging stations (1), by means of the first circuit (11), a pressure lower than an atmospheric pressure measured at 20° C.

In a 29th aspect according to any one of the preceding aspects, the auxiliary pressure device (51) comprises a reservoir, the vacuum pump (50) being configured for defining in said reservoir, through the third fluid circuit (13), a pressure lower than an atmospheric pressure measured at 20° C.

In a 30th aspect according to any one of the preceding aspects, the first and second circuit (11, 12) comprise a plurality of fluid-tight conduits configured for allowing the passage of gas.

In a 31st aspect according to any one of the preceding aspects, the plant comprises at least one control unit (30) configured for enabling or interdicting the fluid communication between at least one of:

at least one of said packaging stations (1) and the vacuum pump (50), at least one of said packaging stations (1) and the pressure auxiliary device (51).

In a 32nd aspect according to any one of the aspects from the 7th to the 31st, the plant comprises at least one control unit (30) connected to the plurality of control valves (20) of the first and second circuits (11, 12) and is configured for independently commanding each valve between the passage condition and closure condition for enabling or interdicting the fluid communication between at least one of:

at least one of said packaging stations (1) and the vacuum pump (50), at least one of said packaging stations (1) and the pressure auxiliary device (51).

In a 33rd aspect according to the preceding aspect, the control unit (30) is also connected to the control valve (20) of the third circuit (13) and is configured for commanding said valve between the passage condition and the closure condition for enabling or inhibiting the fluid communication between the vacuum pump (50) and the auxiliary pressure device (51).

In a 34th aspect according to the preceding aspect, the control unit (30) is configured for independently commanding the control valve of the third circuit (13) with respect to the plurality of control valves (20) of the first and second circuit (11, 12).

In a 35th aspect according to any one of the aspects from the 31st to the 34th, the plant comprises at least one detecting sensor configured for emitting at least one signal representing at least one parameter comprising at least one of:

a pressure present in the inner chamber (4) of at least one packaging station (1), a pressure inside the pressure auxiliary device (51), a pressure of the first circuit (11), optionally a pressure at at least one secondary line (11*b*) of the first circuit (11), a pressure of the second circuit (12), optionally a pressure at at least one secondary line (12*b*) of the second circuit (12), a pressure at the vacuum pump (50), a flow rate of a gas flowing through the first circuit (11), optionally passing from at least one secondary line (11*b*) of the first circuit (11), a flow rate of a gas flowing through the second circuit (12), optionally passing from at least one secondary line (12*b*) of the second circuit (12), a temperature of at least one of the packaging stations (1), a predetermined time interval, a relative position of the upper and lower tools of at least one packaging station (1), a presence of a support (40) supporting a product at a determined packaging station (1), a presence of a closing film (41) at a determined packaging station (1), a predetermined actuation sequence of the plurality of control valves (20) of the first and second circuits, optionally of the third circuit, between the passage condition and closure condition, a condition, for example a passage or closure condition, of the plurality of control valves (20) of the first and second circuits, optionally of the third circuit, wherein the control unit (30) is configured for:

receiving, as an input, said at least one signal, as a function of said at least one signal, determining a value of at least one of said parameters, as a function of the determined value of at least one of said parameters, defining the passage or closure condition of at least one control valve (20) of the second circuit (12) for enabling or interdicting the fluid communication between the pressure auxiliary device (51) and at least one packaging station (1).

In a 36th aspect according to the preceding aspect, the auxiliary pressure device (51) comprises a reservoir, wherein the control unit (30) is configured for defining, according to a determined value of at least one of said parameters, the passage condition of the control valve (20) of the third circuit (13) to allow the fluid communication between the vacuum pump (50) and the auxiliary pressure device (51) for defining within said reservoir a pressure lower than an atmospheric pressure measured at 20° C.

In a 37th aspect according to any one of the aspects from the 31st to the 36th, the control unit (30) is configured for commanding the plurality of control valves (20) between the passage condition and closure condition for defining a first work condition, wherein:

the pump (50) is in fluid communication with at least one first packaging station (1*a*) and is configured for defining, in the inner chamber of said first packaging station (1*a*), a pressure less than the atmospheric pressure measured at 20° C.;

the pressure auxiliary device (51) is in fluid communication with a second packaging station (1*b*) and is configured for:

defining, in the inner chamber of said second packaging station (1*b*), a pressure less than the atmospheric pressure measured at 20° C.; or defining, inside a volume comprised between a closing film (41) in contact with the upper tool and this latter, a pressure less than the atmospheric pressure measured at 20° C.

In a 38th aspect according to any one of the aspects from the 31st to the 37th, the control unit (30) is configured for commanding the plurality of control valves (20) between the passage condition and the closure condition in order to define a second work condition wherein the pump (50) is in fluid communication with the pressure auxiliary device (51) for defining inside said pressure auxiliary device (51) a pressure less than an atmospheric pressure measured at 20° C.

In a 39th aspect according to the preceding aspect, the control unit (30), during the second operative condition, is configured for commanding the plurality of control valves (20) between the passage condition and the closure condition so that the pump (50) is in fluid communication with one or more packaging stations (1) for defining, at the inner chamber (4) of at least one of the packaging stations (1), a pressure less than an atmospheric pressure measured at 20° C.

In a 40th aspect according to any one of the aspects from the 31st to the 37th, the control unit (30) is configured for commanding the plurality of control valves (20) between the passage condition and the closure condition in order to define a second work condition wherein the pump (50) is only in fluid communication with the pressure auxiliary device (51) for defining inside said pressure auxiliary device (51) a pressure less than an atmospheric pressure measured at 20° C., optionally the pump (50), in the second work condition, not being in fluid communication with the packaging stations (1).

In a 41st aspect according to any one of the aspects from the 31st to the 40th, the control unit (30) is configured for commanding the plurality of control valves (20) between the passage condition and closure condition for defining a third work condition, wherein:

at least one packaging station (1) exhibits a pressure, at the respective inner chamber (4), less than a pressure inside the pressure auxiliary device (51), and said packaging station (1) being put in fluid communication with said pressure auxiliary device (51) for determining a passage of a gas from the pressure auxiliary device (51) to said packaging station (1).

In a 42nd aspect according to the preceding aspect wherein in said third work condition, the pump (50) is in fluid communication with at least one packaging station (1) so as to define, in the inner chamber (4) of said at least one packaging station (1), a pressure lower than the atmospheric pressure measured at 20° C.

In a 43rd aspect according to any one of the preceding aspects, the plant comprises:

a conveyor (302) configured for moving a plurality of supports (40), optionally a plurality of supports carrying a product, along a predetermined advancement path, a feeding group (303) of a closure film (201) configured for feeding said film to at least one packaging station.

In a 44th aspect according to the preceding aspect, the control unit (30) is configured for synchronizing the operations performed by the feeding group (303) of the closing film with the movement of the conveyor (302).

In a 45th aspect according to any one of the aspects from the 11th to the 44th, the upper tool (2) of one or more packaging stations (1) comprises a plurality of passage holes (15) configured for putting in fluid communication at least one portion inside the relative packaging station (1) with at least one from the group of:

at least one secondary line (11*b*) of the first circuit (11);

at least one secondary line (12*b*) of the second circuit (12);

at least one discharge line (14);

optionally wherein at least one end of said passage holes (15) is placed at an inner surface of the upper tool (2).

In a 46th aspect, a packaging process of products (P) is provided, using the plant (100) according to any one of the preceding aspects.

In a 47th aspect according to the preceding aspect, the process comprises at least the following sub-steps:

gas suction through the first circuit (11) and by means of said vacuum pump (50) by, optionally within, at least a first packaging station (1*a*) so as to define inside at least one section of said first packaging station a pressure lower than an atmospheric pressure measured at 20° C.;

suctioning gas through the auxiliary pressure device (51) by, optionally within, a second packaging station (1*b*) distinct from said at least one first packaging station (1*a*).

In a 48th aspect according to the preceding aspect, wherein the gas suction steps from the first and second packaging stations are at least partially overlapped in such a way that, during the gas suction step from the first packaging station through the vacuum pump, the auxiliary pressure device suctions gas from the second packaging station.

In a 49th aspect according to the 46th or 47th or 48th aspect, the process includes at least:

one gas suctioning step inside at least one first packaging station (1*a*) for defining within the latter a pressure less than an atmospheric pressure measured at 20° C. through the first circuit (11) and by means of said vacuum pump (50);

one step of putting in fluid communication the at least one pressure auxiliary device (51) with at least one second packaging station (1*b*) distinct from said at least one first packaging station (1*a*), wherein said at least one second packaging station (1*b*) internally exhibits a pressure greater than a pressure present inside the pressure auxiliary device (51), for determining a passage of a gas from said second packaging station (1*b*) towards the reservoir of the pressure auxiliary device (51).

In a 50th aspect according to any one of the aspects from the 46th to the 49th, the auxiliary pressure device (51) comprises at least one reservoir, wherein the process comprises at least one pressure recovery step in which said reservoir is placed in fluid communication with at least one packaging station having therein a pressure lower than a pressure present inside the at least one auxiliary pressure device (51) so as to reduce the pressure present in said at least one pressure auxiliary device (51).

In a 51st aspect according to any one of the aspects from the 46th to the 50th, wherein the auxiliary pressure device (51) comprises at least one reservoir, wherein the process comprises at least one charging step of said reservoir in which:

the reservoir is put in fluid communication with the vacuum pump (50) through the third circuit (13), the vacuum pump (50) suctions gas from the reservoir to define within it a pressure lower than the atmospheric pressure measured at 20° C.

In a 52nd aspect according to the preceding aspect, in said charging step, the primary line (11*a*) of the first circuit (11) is put in fluid communication with the primary line (12*a*) of the second circuit (12) through said third circuit (13).

In a 53rd aspect according to any one of the aspects from the 46th to the 52nd, the process comprising at least one packaging step carried out by at least one of said packaging stations (1), wherein said packaging step comprises:

disposing the upper and lower tools (2, 3) of a packaging station (1) in the closed position in order to define the fluid-tight inner chamber (4) in which a closing film (41) and a support (40) supporting a product (P), are housed, defining inside said inner chamber (4) a pressure less than an atmospheric pressure measured at 20° C., optionally through the first circuit (11) and by means of said vacuum pump (50), welding said closing film (41) to the support (40) in order to make a fluid-tight vacuum package (40*a*) housing the product (P).

In a 54th aspect according to the preceding aspect, the packaging step further comprises the following sub-steps:

placing the closing film in contact with a lower surface of the upper tool (2) at least partly facing the lower tool (3), heating said upper tool (2), optionally heating the lower surface of the upper tool (2) at least partially facing the lower tool (3), so as to heat the closing film (41) in contact with said upper tool (2).

In a 55th aspect according to the 53rd or 54th aspect, wherein, when performing a packaging step in at least one first packaging station (1*a*), the process provides at least one of the following additional steps:

putting in fluid communication a second packaging station (1*b*), distinct from the first packaging station (1*a*), with the vacuum pump (50) through the first circuit (11), optionally through a secondary line (11*b*) of the first circuit (11), putting in fluid communication a second packaging station (1*b*), distinct from the first packaging station (1*a*), with the pressure auxiliary device (51) through the second circuit (12), optionally through a secondary line (12*b*) of the second circuit (12), putting in fluid communication the vacuum pump (50) with the pressure auxiliary device (51) through the third circuit (13).

In a 56th aspect according to any one of the aspects from the 46th to the 55th, wherein the additional steps are implemented by the control unit (30) by means of the plurality of control valves (20) independently between the passage condition and the closure condition for enabling or inhibiting fluid communication between at least one of:

at least one of said packaging stations (1) and the vacuum pump (50), at least one of said packaging stations (1) and the pressure auxiliary device (51), the vacuum pump (50) and the auxiliary pressure device (51).

In a 57th aspect according to any one of the aspects from the 46th to the 56th, wherein the control unit (30), provides for the following steps:

receiving at least one signal representative of a parameter comprising at least one of:

a pressure present in the inner chamber (4) of at least one packaging station (1), a pressure inside the pressure auxiliary device (51), a pressure of the first circuit (11), optionally a pressure value at at least one secondary line (11*b*) of the first circuit (11), a pressure of the second circuit (12), optionally a pressure value at at least one secondary line (12*b*) of the second circuit (12), a pressure at the vacuum pump (50), a flow rate of a gas flowing through the first circuit (11), optionally passing from at least one secondary line (11*b*) of the first circuit (11), a flow rate of a gas flowing through the second circuit (12), optionally passing from at least one secondary line (12*b*) of the second circuit (12), a temperature of at least one of the packaging stations (1), a predetermined time interval, a relative position of the upper and lower tools (2, 3) of at least one packaging station (1), a presence of a support (40) supporting a product (P) at a determined packaging station (1), a presence of a closing film (41) at a determined packaging station (1), a predetermined actuation sequence of the plurality of control valves (20) of the first and second circuits (11, 12), optionally of the third circuit (13), between the passage condition and closure condition, a condition, for example a passage or closure condition, of the plurality of control valves (20) of the first and second circuits (11, 12), optionally of the third circuit (13);

determining a value of at least one of said parameters, defining, as a function of the determined value of at least one of said parameters, the passage or closure condition of at least one control valve (20) of the second circuit (12) for enabling or interdicting the fluid communication between the pressure auxiliary device (51) and at least one packaging station (1).

In a 58th aspect according to any one of the aspects from the 46th to the 57th, the control unit (30) independently commands the plurality of control valves (20) between the passage condition and the closure condition so as to define the first work condition, said control step, performed by the control unit (30) for defining the first work condition, comprising the following sub-steps:

putting the pump (50) in fluid communication with at least one first packaging station (1*a*) for suctioning gas from the inner chamber (4) of said first packaging station (1*a*) so as to define, within the latter, a pressure lower than the atmospheric pressure measured at 20° C.;

putting the pressure auxiliary device (51) in fluid communication with a second packaging station (1*b*), said auxiliary pressure device (51) having therein a pressure lower than the atmospheric pressure measured at 20° C. and suctioning at at least one of:

the inner chamber (4) of said second packaging station (1*b*) so as to define a pressure lower than the atmospheric pressure measured at 20° C.;

a volume comprised between a closing film in contact with the upper tool (41) and this latter so as to define a pressure less than the atmospheric pressure measured at 20° C.

In a 59th aspect according to any one of the aspects from the 46th to the 58th, wherein the control unit (30) is independently commands the plurality of control valves (20) between the passage condition and closure condition for defining a second work condition.

In a 60th aspect according to the preceding aspect, the auxiliary pressure device (51) comprises at least one reservoir, said control step, performed by the control unit (30) for defining the second work condition, comprising at least one step of putting the pump (50) in fluid communication with said reservoir for suctioning gas from the latter so as to define, inside the reservoir, a pressure lower than an atmospheric pressure measured at 20° C.

In a 61st aspect according to any one of the aspects from the 46th to the 60th, wherein the control unit (30) independently commands the plurality of control valves (20) between the passage condition and the closure condition in such a way as to define the third work condition, said control step, performed by the control unit (30) for defining the third work condition, comprising at least one step of putting in fluid communication at least one packaging station, having a pressure at the respective inner chamber (4) lower than a pressure inside the auxiliary pressure device (51), with said auxiliary pressure device so as to cause a passage of gas from the auxiliary pressure device (51) to said packaging station (1).

In a 62nd aspect according to the preceding aspect wherein in the third work condition, the pump (50) is in fluid communication with at least one packaging station (1) so as to define, in the inner chamber (4) of said at least one packaging station (1), a pressure lower than the atmospheric pressure measured at 20° C.

BRIEF DESCRIPTION OF THE DRAWINGS

Some embodiments and some aspects of the invention are described hereinafter with reference to the accompanying drawings, provided only for illustrative and, therefore, non-limiting purposes, in which.

CONVENTIONS

Figure 1:
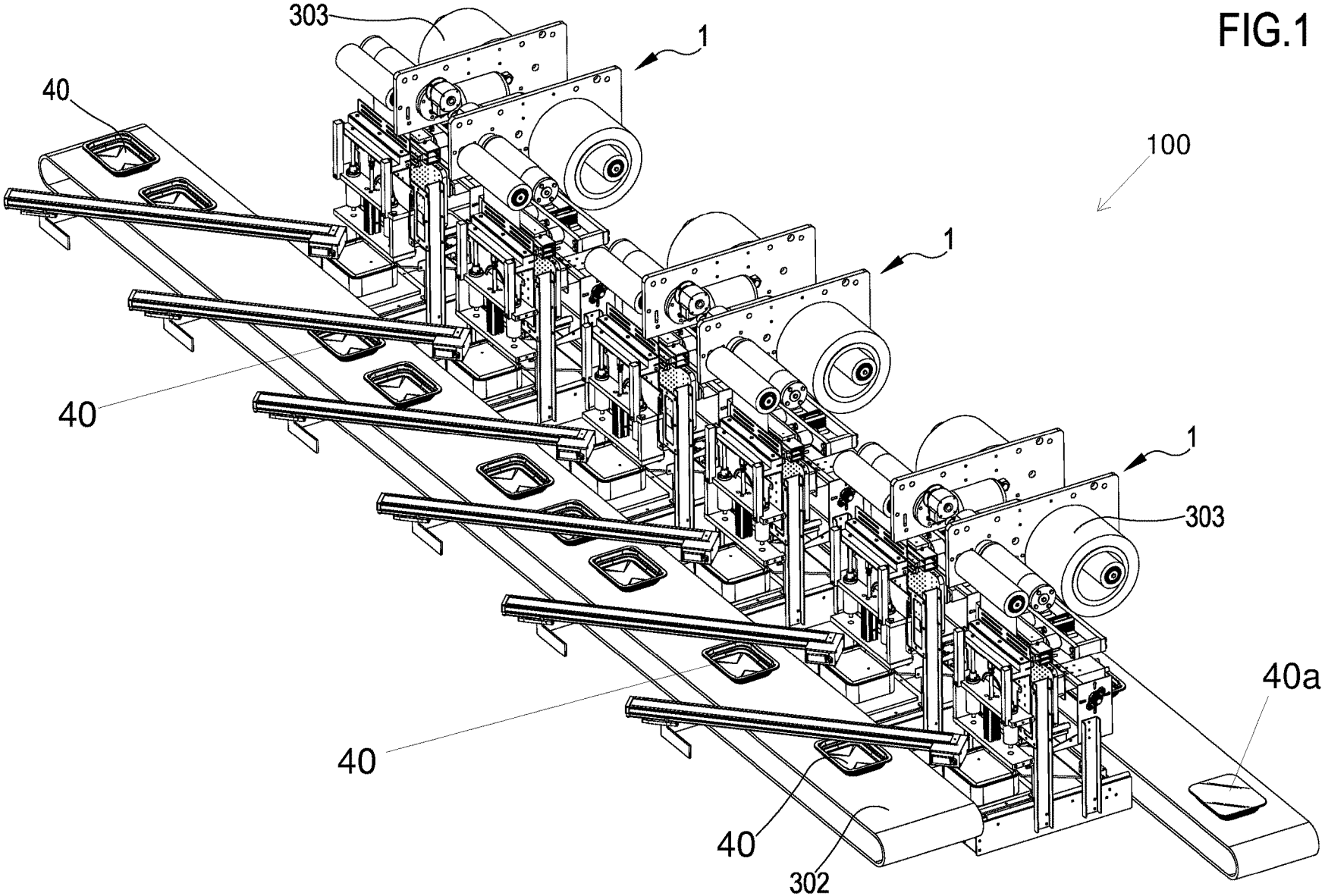
FIG. 1 is a perspective partially top view of a vacuum packaging plant according to the present invention.

It should be noted that in the present detailed description, corresponding parts illustrated in the various figures are indicated by the same reference numerals. The figures may illustrate the object of the invention by representations that are not in scale; therefore, parts and components illustrated in the figures relating to the object of the invention may relate solely to schematic representations.

The terms upstream and downstream refer to a direction of advancement of a package—or of a support for making said package—along a predetermined path starting from a starting or forming station of a support for said package, through a packaging station and then up to a package unloading station.

Definitions

Product

The term product P means an article or a composite of articles of any kind. For example, the product may be of a foodstuff type and be in solid, liquid or gel form, i.e. in the form of two or more of the aforementioned aggregation states. In the food sector, the product may comprise: meat, fish, cheese, treated meats, prepared and frozen meals of various kinds.

Control Unit

The packaging apparatus described and claimed herein includes at least one control unit designed to control the operations performed by the apparatus. The control unit can clearly be only one or be formed by a plurality of different control units according to the design choices and the operational needs.

The term control unit means an electronic component which can comprise at least one of: a digital processor (for example comprising at least one selected from the group of: CPU, GPU, GPGPU), a memory (or memories), an analog circuit, or a combination of one or more digital processing units with one or more analog circuits. The control unit can be "configured" or "programmed" to perform some steps: this can be done in practice by any means that allows configuring or programming the control unit. For example, in the case of a control unit comprising one or more CPUs and one or more memories, one or more programs can be stored in appropriate memory banks connected to the CPU or to the CPUs; the program or programs contain instructions which, when executed by the CPU or the CPUs, program or configure the control unit to perform the operations described in relation to the control unit. Alternatively, if the control unit is or includes analog circuitry, then the control unit circuit may be designed to include circuitry configured, in use, for processing electrical signals so as to perform the steps related to control unit. The control unit may comprise one or more digital units, for example of the microprocessor type, or one or more analog units, or a suitable combination of digital and analog units; the control unit can be configured for coordinating all the actions necessary for executing an instruction and instruction sets.

Actuator

The term actuator means any device capable of causing movement on a body, for example on a command of the control unit (reception by the actuator of a command sent by the control unit). The actuator can be of an electric, pneumatic, mechanical (for example with a spring) type, or of another type.

Support

The term support means both a flat support and a tray comprising at least one base and at least one lateral wall emerging from the outer perimeter of the base and optionally a terminal flange emerging radially outwardly from an upper peripheral edge of the lateral wall. The outer flange can extend along a single prevailing development plane or can be shaped; in the case of a shaped outer flange, the latter may for example exhibit multiple portions extending along different prevailing development planes, particularly parallel but offset from each other. The portions of the shaped external flange can be radially offset.

The support defines a top surface on which the product P can be placed and/or a volume inside which the product can be housed. The tray may comprise an upper edge portion emerging radially from a free edge of the lateral wall opposite the base: the upper edge portion emerges from the lateral wall in an outgoing direction relative to the tray volume. The flat support can be of any shape, for example rectangular, rhomboidal, circular or elliptical; similarly, the tray with lateral wall can have a base of any shape, for example rectangular, rhomboidal, circular or elliptical. The support can be formed by means of a specific manufacturing process distinct from the packaging process or can be implemented in line with the packaging process.

The support can be made at least partly of paper material, optionally having at least 50% by weight, even more optionally at least 70% by weight, of organic material comprising one or more of cellulose, hemicellulose, lignin, lignin derivatives. The subject paper material extends between a first and a second prevailing development surface. The paper sheet material used for making the support may, in one embodiment variant, be covered by at least a part of the first and/or second prevailing development surface by means of a plastic coating, such as a food-grade film. If the coating is arranged so as to cover at least part of the first prevailing development surface, the same coating will define an inner surface of the support. Vice versa, if the coating is arranged on the second prevailing development surface, the same coating will define an outer surface of the support. The coating may also be heat-treated in such a way as to be able to act as an element for engaging and securing portions of the support as better described below. The coating may also be used to define a sort of barrier to water and/or humidity useful for preventing the weakening and loss of structurality of the support with consequent uncontrolled deformation of the paper material constituting the latter component. The coating can be applied to the paper material (as specified above on the inside and/or outside of the support) in the form of a so-called lacquer deposited from a solution or sprayed, the thickness whereof is generally comprised between 0.2 μm and 10 μm. Alternatively, the coating may comprise a plastic film, for example a polyethylene, which can be applied by means of a rolling process, on one or both sides (inner and/or outer side) of the paper material defining the support. In case the coating is applied by rolling, the values of the plastic film (coating) may, for example, range from 10 μm to 400 μm, in particular, from 20 μm to 200 μm, even more in particular, from 30 μm to 80 μm, of coating material (i.e., polyethylene). The plastic coating material may be selected, by way of example, from the following materials: PP, PE (HDPE, LDPE, MDPE, LLDPE), EVA, polyesters (including PET and PETg), PVdC.

The support may be alternatively made at least in part of a mono-layer and multilayer thermoplastic material. The support may be provided with gas barrier properties. As used herein, this term refers to a film or sheet of material that has an oxygen transmission rate of less than 200 $cm^3/(m^2*day*bar)$, less than 150 $cm^3/(m^2*day*bar)$, less than 100 $cm^3/(m^2*day*bar)$ when measured in accordance with ASTM D-3985 at 23° C. and 0% relative humidity. Gas barrier materials suitable for single-layer thermoplastic containers are e.g. polyesters, polyamides, ethylene vinyl alcohol (EVOH), PVdC and the like.

The support can be of multilayer material comprising at least one gas barrier layer and at least one heat-sealable layer to allow sealing the covering film on the surface of the support. The gas barrier polymers that can be used for the gas barrier layer are PVDC, EVOH, polyamides, polyesters and mixtures thereof. Generally, a PVDC barrier layer will contain plasticizers and/or stabilizers as known in the art. The thickness of the gas barrier layer will preferably be set in order to provide the material of which the support is composed with an oxygen transmission rate at 23° C. and 0% relative humidity of less than 50 $cm^3/(m^2*day*atm)$, optionally less than 10 $cm^3/(m^2*day*atm)$, when measured in accordance with ASTM D-3985. In general, the heat-sealable layer will be selected from polyolefins, such as ethylene homo- or copolymers, propylene homo- or copolymers, ethylene/vinylacetate copolymers, ionomers and homo- or co-polyesters, e.g. PETG, a glycol-modified polyethylene terephthalate. Additional layers, such as adhesive layers, for example to make the gas barrier layer better adhere to the adjacent layers, may preferably be present in the material of which the support is made and are selected based on the specific resins used for the gas barrier layer. In the case of a multilayer structure, part of this can be formed as a foam. For example, the multilayer material used for forming the support can comprise (from the outermost layer to the layer of contact with the more internal foods) one or more structural layers, typically made of a material such as expanded polystyrene, expanded polyester or expanded polypropylene, or of cardboard, or sheet for example polypropylene, polystyrene, poly(vinyl chloride), polyester; a gas barrier layer and a heat-sealable layer.

A frangible layer that is easy to open can be positioned adjacent to the thermo-weldable layer to facilitate the opening of the final packaging. Blends of low-cohesion polymers which can be used as a frangible layer are for example those described in WO99/54398. The overall thickness of the support will be typically up to 5 mm, optionally comprised between 0.04 and 3.00 mm, optionally between 0.15 and 1.00 mm. The support may be made entirely of paper material (optionally coating in plastic film) or it may be entirely made of plastic material. In a further embodiment, the support is at least partly made of paper material and at least partly of plastic material; in particular, the support is made internally of plastic material and externally covered at least partly in paper material. The support can also be used to define so-called ready-meal packages; in this configuration, the supports are made so that they can be inserted in the oven for heating and/or cooking the food product placed in the package. In this embodiment (supports for ready-meal packages), the support can, for example, be made of paper material, in particular cardboard, covered with polyester or can be entirely made of a polyester resin. For example, supports suitable for ready-meal packages are made of CPET, APET or APET/CPET, foamed or non-foamed materials. The support may further comprise a hot-weldable layer of a low melting material on the film. This hot-weldable layer can be co-extruded with a PET-based layer (as described in the patent applications No. EP 1 529 797 and WO 2007/093495) or it can be deposited on the base film by means of deposition with solvent means or by means of extrusion coating (e.g. described in the documents U.S. Pat. No. 2,762,720 and EP 1 252 008). In a further embodiment, the support may be made at least partly of metal material, in particular aluminum. The support can also be made at least partly of aluminum and at least partly of paper material. In general, the support can be made in at least one of the following materials: metal, plastic, paper.

Film

A film made of plastic material, in particular polymeric material, is applied to the supports (flat supports or trays), so as to create a fluid-tight package housing the product. In order to make a vacuum pack, the film applied to the support is typically a flexible multilayer material comprising at least a first outer heat-weldable layer capable of welding to the inner surface of the support, optionally a gas barrier layer and a second, heat-resistant outer layer. For use in a skin-pack or VSP packaging process, plastic materials, especially polymers, should be easily formed as the film needs to be stretched and softened by contact with the heating plate before it is laid on the product and the support. The film must rest on the product conforming to its shape and possibly to the internal shape of the support.

The thermo-weldable outer layer can comprise any polymer capable of welding to the inner surface of the support. Suitable polymers for the thermo-weldable layer can be ethylene and ethylene copolymers, such as LDPE, ethylene/alpha-olefin copolymers, ethylene/acrylic acid copolymers, ethylene/vinyl acetate copolymers or ethylene/vinyl acetate copolymers, ionomers, co-polyesters, for example PETG. Preferred materials for the thermo-weldable layer are LDPE, ethylene/alpha-olefin copolymers, e.g. LLDPE, ionomers, ethylene/vinyl acetate copolymers and mixtures thereof.

Depending on the product to be packaged, the film may comprise a gas barrier layer. The gas barrier layer typically comprises oxygen-impermeable resins such as PVDC, EVOH, polyamides and mixtures of EVOH and polyamides. Typically, the thickness of the gas barrier layer is set to provide the film with an oxygen transmission rate of 23° C. and 0% relative humidity of, less than 100 $cm^3/m^2*m^2*atm$, preferably less than 50 $cm^3/(m^2*day*atm)$, when measured in accordance with ASTM D-3985. Common polymers for the heat-resistant outer layer are, for example, ethylene homo- or copolymers, in particular HDPE, ethylene copolymers and cyclic olefins, such as ethylne/norbornene copolymers, propylene homo- or copolymers, ionomers, polyesters, polyamides. The film may further comprise other layers such as adhesive layers, filling layers and the like to provide the thickness necessary for the film and improve its mechanical properties, such as puncture resistance, abuse resistance, formability and the like. The film is obtainable by any suitable co-extrusion process, through a flat or circular extrusion head, optionally by co-extrusion or by hot blow molding.

The film is substantially not oriented; the film, or only one or more of its layers, is crosslinked to improve, for example, the strength of the film and/or heat resistance when the film is brought into contact with the heating plate during the vacuum skin packaging process. Crosslinking can be achieved by using chemical additives or by subjecting the film layers to an energy-radiation treatment, such as high-energy electron beam treatment, to induce crosslinking between molecules of the irradiated material. Films suitable for this application have a thickness in the range between 50 μm and 200 μm, optionally between 70 μm and 150 μm.

The film applied to the support (plastic material, in particular polymeric film) is typically mono-layer or multi-layer, having at least one heat-sealable layer, possibly capable of thermo-retracting under heat action. The applied film may further comprise at least one gas barrier layer and optionally a heat-resistant outer layer. In particular, the film can be obtained by co-extrusion and lamination processes. The film may have a symmetrical or asymmetrical structure and may be single-layer or multilayer. Multilayer films are composed of at least two layers, more frequently at least five layers, often at least seven layers. Generally, the total thickness of the film ranges from 3 μm to 100 μm, normally it ranges from 5 μm to 50 μm, often it ranges from 10 μm to 30 μm.

The films described above can be heat-shrinkable or heat-curable. Heat-shrinkable films normally show a free shrinking value at 120° C. (value measured in accordance with ASTM D2732, in oil) in the range from 2% to 80%, normally from 5% to 60%, in particular from 10% to 40% in both longitudinal and transverse directions. Heat-curable films normally have a shrinkage value of less than 10% at 120° C., normally less than 5% both in the transverse and longitudinal direction (measured in accordance with the ASTM D2732 method, in oil). Films normally comprise at least one heat-sealable layer and an outer layer (the outermost) generally consisting of heat-resistant polymers or polyolefins. The welding layer typically comprises a heat-sealable polyolefin which in turn comprises a single polyolefin or a mixture of two or more polyolefins such as polyethylene or polypropylene or a mixture thereof. The welding layer may also be provided with anti-fogging properties through known techniques, for example by incorporation in its composition of anti-fogging additives or through a coating or a spraying of one or more anti-fogging additives that counteract the fogging on the surface of the welding layer. The welding layer may also comprise one or more plasticizers. The outermost layer may comprise polyesters, polyamides or polyolefins. In some structures, a mixture of polyamide and polyester can be advantageously used for the outermost layer. In some cases, the films include a gas barrier layer. Barrier films normally have an oxygen transmission rate, also called OTR (Oxygen Transmission Rate) below 200 $cm^3/(m^2*day*atm)$ and more frequently below 80 $cm^3/(m^2*day*atm)$ evaluated at 23° C. and 0% RH measured in accordance with the ASTM D-3985 method. The barrier layer may normally consist of a thermoplastic resin selected from a saponified or hydrolyzed product of ethylene-vinyl acetate copolymer (EVOH), an amorphous polyamide and vinyl-vinylidene chloride and mixtures thereof. Some materials include an EVOH barrier layer, layered between two polyamide layers. In some packaging applications, films do not include any gas barrier layer. These films usually comprise one or more polyolefins as defined herein. Non-gas barrier films exhibit an OTR (evaluated at 23° C. and 0% RH in accordance with ASTM D-3985) of 100 $cm^3/(m^2*day*atm)$ up to 10000 $cm^3/(m^2*day*atm)$, more often up to 6000 $cm^3/(m^2*day*atm)$.

Peculiar compositions based on polyester are those used for the films of the so-called ready-meals. For these films, the polyester resins of the film may constitute at least 50%, 60%, 70%, 80% and 90% by weight of the film. These films are normally used in combination with supports, especially trays, made from polyester. In the case of packages for fresh red meat, a double film may be used, comprising an oxygen permeable inner film and an oxygen impermeable outer film. The combination of these two films greatly prevents discoloration of the meat even in the most critical situation in the barrier packaging of fresh meat or when the packaged meat extends outside the cavity defined by the tray, or in which the product emerges from the upper peripheral edge of the lateral wall. These films are described for example in European patent applications EP 1 848 635 and EP 0 690 012.

The film may be single-layer. The typical composition of the single-layer films comprises the polyesters as defined herein and mixtures thereof or the polyolefins as defined herein and mixtures thereof.

In all the film layers described herein, the polymeric components may contain suitable amounts of additives normally included in such compositions. Some of these additives are normally included in the outer layers or in one of the outer layers, while others are normally added to the inner layers. These additives include slipping or anti-blocking agents such as talc, waxes, silica and the like, or antioxidant agents, stabilizers, plasticizers, fillers, pigments and dyes, cross-linking inhibitors, cross-linking agents, UV absorbers, odor absorbers, oxygen absorbers, bactericides, antistatic agents, antifog agents or compositions and similar additives known to the man skilled in the art of packaging.

The films may have one or more holes adapted to allow the fluid communication between the inner volume of the package and the external environment, or, in the case of a food product, allow the packaged food to exchange gas with the outside; the perforation of the films can, for example, be performed by means of a laser beam or mechanical means, such as rollers provided with needles. The number of perforations applied and the size of the holes influence the permeability to the gases of the film itself.

Micro-perforated films are usually characterized by OTR values (evaluated at 23° C. and 0% RH in accordance with ASTM D-3985) of 2500 $cm^3/(m^2*day*atm)$ up to 1000000 $cm^3/(m^2*day*atm)$. Macro-perforated films are usually characterized by OTR values (evaluated at 23° C. and 0% RH in accordance with ASTM D-3985) higher than 1000000 $cm^3/(m^2*day*atm)$. Furthermore, the films described herein can be formulated to provide strong welds with the support or tray or peelable from the tray/support. A method of measuring the strength of a weld, herein referred to as a "welding force, is described in ASTM F-88-00. Acceptable welding force values to have a peelable weld are between 100 g/25 mm and 850 g/25 mm, 150 g/25 mm to 800 g/25 mm, 200 g/25 mm to 700 g/25 mm.

Material Specifications

The term paper material means paper or cardboard; in particular, the sheet material that can be used to make the support can have a weight of between 30 $g/m^2$ and 600 $g/m^2$, in particular between 40 $g/m^2$ and 500 $g/m^2$, even more particularly between 50 $g/m^2$ and 250 $g/m^2$.

PVDC is any vinylidene chloride copolymer in which a prevalent amount of the copolymer comprises vinylidene chloride and a lower amount of the copolymer comprises one or more unsaturated monomers copolymerizable therewith, typically vinyl chloride and alkyl acrylates or methacrylates (for example methyl acrylate or methacrylate) and mixtures thereof in different proportions.

The term EVOH includes saponified or hydrolyzed ethylene-vinyl acetate copolymers and refers to ethylene/vinyl alcohol copolymers having an ethylene co-monomer content preferably composed of a percentage of from about 28 mole % to about 48 mole %, more preferably from about 32 mole % and about 44 mole % of ethylene and even more preferably, and a saponification degree of at least 85%, preferably at least 90%.

The term polyamides is meant to indicate homo- and co- or ter-polymers. This term specifically includes aliphatic polyam ides or co-polyam ides, e.g. polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partly aromatic polyamides or copolyamides, such as polyamide 61, polyamide 6I/6T, polyamide MXD6, polyamide MXD6/MXDI, and mixtures thereof.

The term polyesters refers to polymers obtained from the polycondensation reaction of dicarboxylic acids with dihydroxylic alcohols. Suitable dicarboxylic acids are, for example, terephthalic acid, isophthalic acid, 2,6-naphthalene dicarboxylic acid and the like. Suitable dihydroxylic alcohols are for example ethylene glycol, diethylene glycol, 1,4-butanediol, 1,4-cyclohexanodimethanol and the like. Examples of useful polyesters include poly(ethylene terephthalate) and copolyesters obtained by reaction of one or more carboxylic acids with one or more dihydroxylic alcohols.

The term copolymer means a polymer derived from two or more types of monomers and includes terpolymers. Ethylene homo-polymers include high density polyethylene (HDPE) and low density polyethylene (LDPE). Ethylene copolymers include ethylene/alphaolefin copolymers and unsaturated ethylene/ester copolymers. The ethylene/alpha-olefin copolymers generally include copolymers of ethylene and one or more co-monomers selected from alpha-olefins having between 3 and 20 carbon atoms, such as 1-butene, 1-pentene, 1-hexene, 1-octene, 4-methyl-1-pentene and the like. Ethylene/alpha-olefin copolymers generally have a density in the range of from about 0.86 g/cm$^3$ to about 0.94 g/cm$^3$. It is generally understood that the term linear low density polyethylene (LLDPE) includes that group of ethylene/alpha-olefin copolymers which fall in the density range of between about 0.915 g/cm$^3$ and about 0.94 g/cm$^3$ and in particular between about 0.915 g/cm$^3$ and about 0.925 g/cm$^3$. Sometimes, linear polyethylene in the density range between about 0.926 g/cm$^3$ and about 0.94 g/cm$^3$ is referred to as linear medium density polyethylene (LMDPE). Lower density ethylene/alpha-olefin copolymers may be referred to as very low density polyethylene (VLDPE) and ultra-low density polyethylene (ULDPE). Ethylene/alpha-olefin copolymers can be obtained with heterogeneous or homogeneous polymerization processes. Another useful ethylene copolymer is an unsaturated ethylene/ester copolymer, which is the ethylene copolymer and one or more unsaturated ester monomers. Useful unsaturated esters include vinyl esters of aliphatic carboxylic acids, in which esters have between 4 and 12 carbon atoms, such as vinyl acetate, and alkyl esters of acrylic or methacrylic acid, in which esters have between 4 and 12 carbon atoms. Lonomers are copolymers of an ethylene and an unsaturated mono-carboxylic acid having the carboxylic acid neutralized by a metal ion, such as zinc or, preferably, sodium. Useful propylene copolymers include propylene/ethylene copolymers, which are copolymers of propylene and ethylene having a percentage by weight content mostly of propylene and propylene/ethylene/butene ter-polymers, which are copolymers of propylene, ethylene and 1-butene.

DETAILED DESCRIPTION

Packaging Plant

The object of the present invention is a vacuum packaging plant 100 of products P for the production of vacuum-tight packages, also referred to as skin packages. The plant 100 is adapted to make packages 40*a* of the type comprising a support 40 supporting the product P (the support 40 may be of the flat type or have one or more side walls so as to define a concave tray inside which to insert said product P) and a closing film 41 firmly engaged with the support 40 and in contact with at least part of the product P. Inside the package 40*a* there is a pressure lower than the atmospheric pressure measured at 20° C.: the closing film 41 is firmly engaged with the support and at least partly in contact with the product so as to define around the latter a sort of skin closing the package.

The plant 100, as illustrated for example in FIG. 1 and schematically in FIGS. 5-14, comprises a plurality of packaging stations 1 distinct from each other and configured for performing the vacuum packaging of products P separately, as will be better described below. FIG. 1 shows a plant 100 having a plurality of stations 1 placed next to each other to essentially define a single production line. The plant 100 further comprises a vacuum pump 50, a first circuit 11 configured for putting in fluid communication the vacuum pump 50 with the plurality of packaging stations 1, at least one pressure auxiliary device 51, at least one second circuit 12 configured for putting at least one of said packaging stations 1 in fluid communication with the at least one auxiliary pressure device 51.

Figure 2:
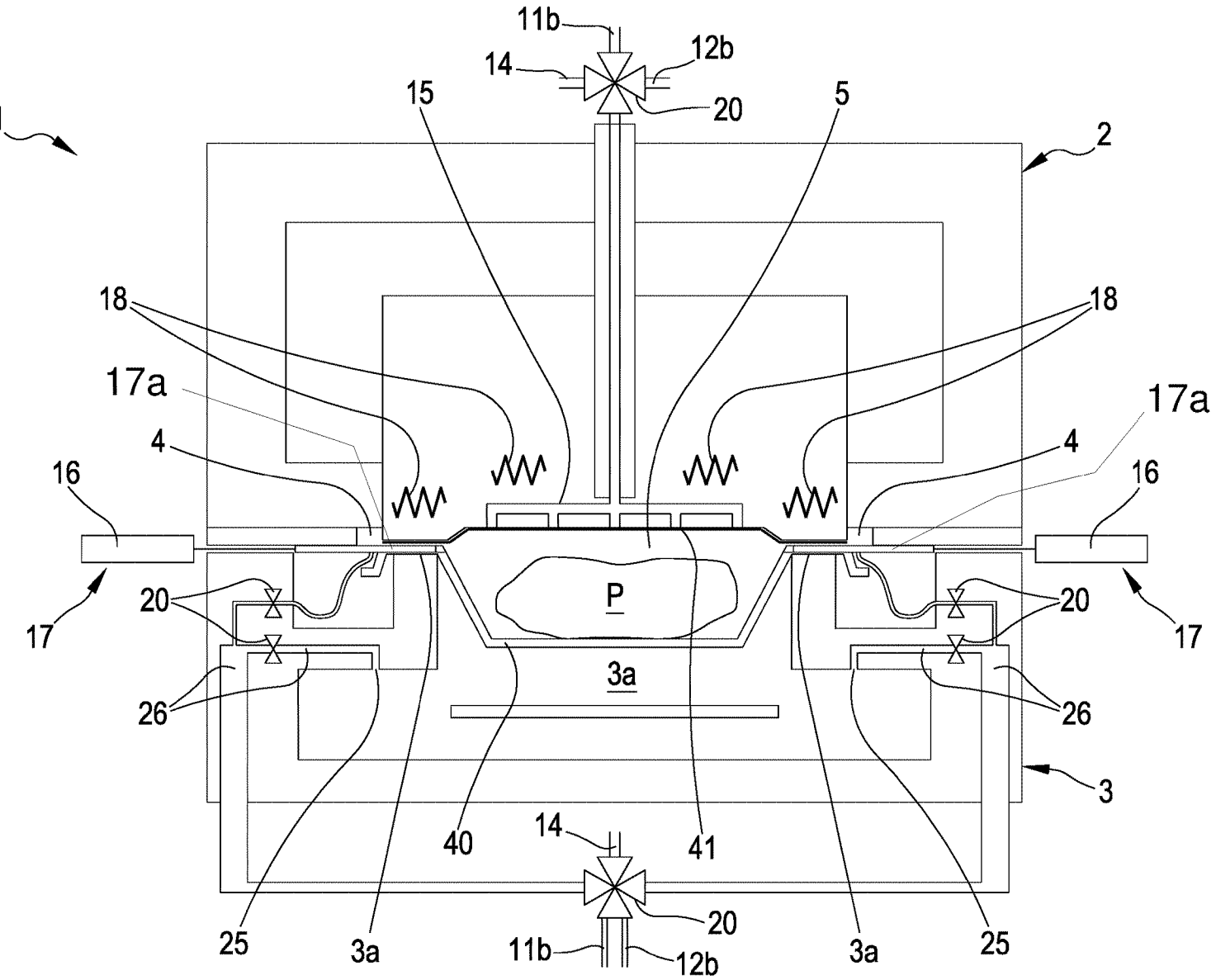
FIGS. 2 to 4 are schematic views of a packaging station for a packaging plant according to the present invention.
Figure 3:
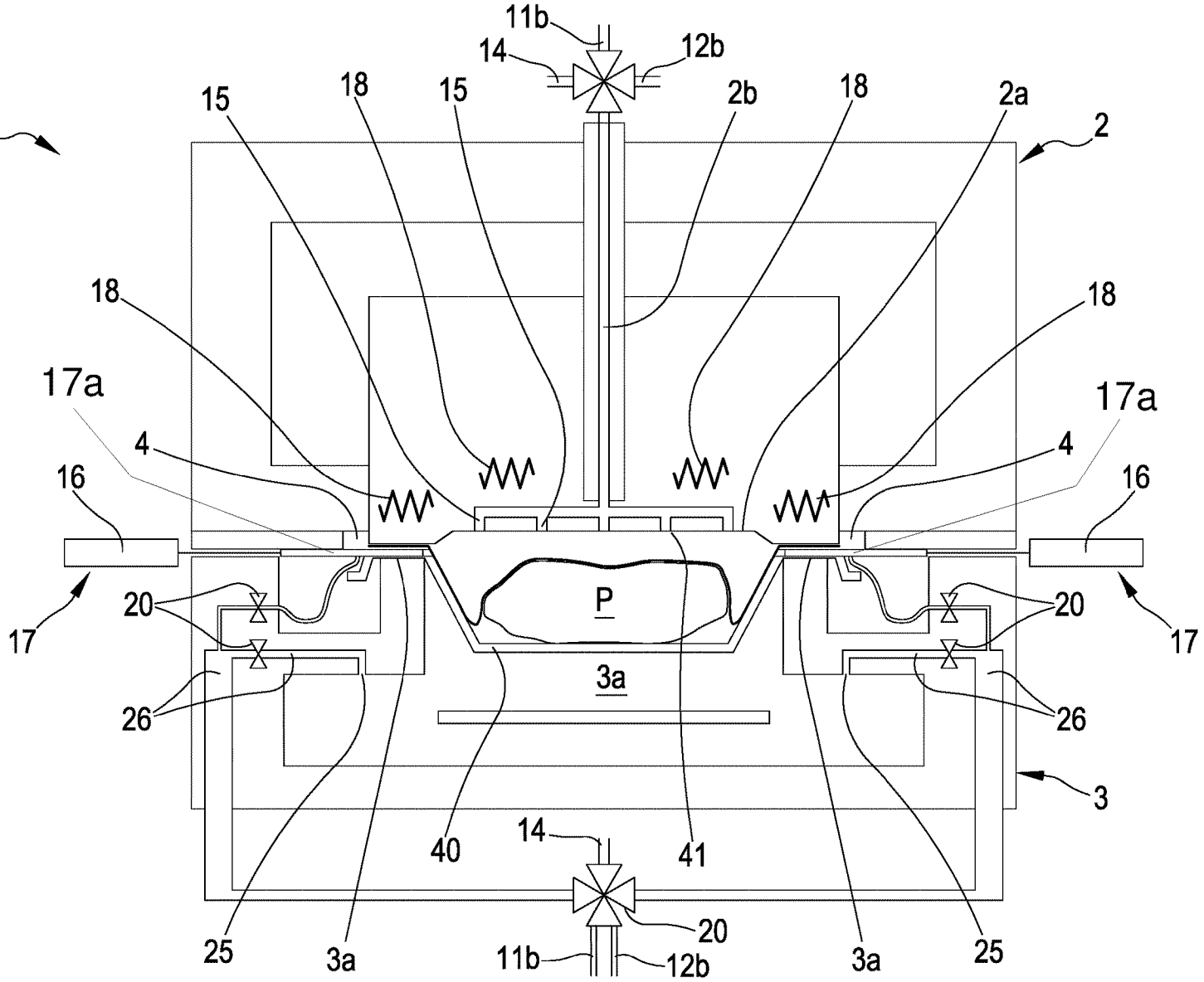
Figure 4:
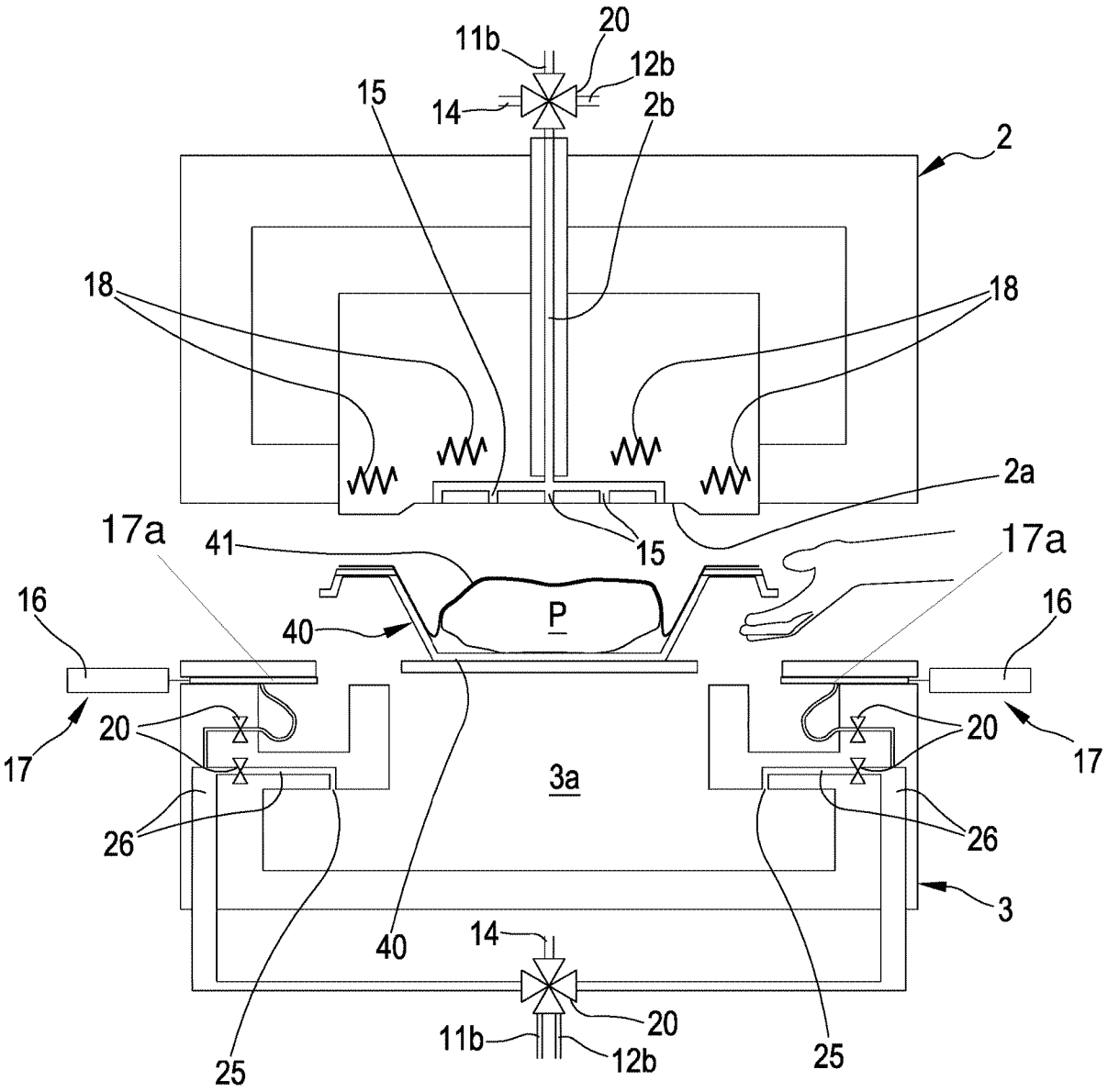

As shown in FIGS. 2-4, each packaging station 1 comprises an upper tool 2 and a lower tool 3 movable relative to each other from a distal position (FIG. 4), wherein the upper and lower tool 2, 3 are distanced from each other and an approached position (FIGS. 2 and 3), wherein the latter cooperate to define a fluid-tight inner chamber 4. In particular, in the distal position the upper and lower tool are configured for allowing the insertion of at least one support 40 supporting at least one product P and at least one closing film 41. In the distal position, the upper and lower tool are also configured for allowing the extraction of vacuum packs made at the end of the packaging process, as illustrated for example in FIG. 4. In the approached position (FIGS. 2 and 3), the lower and upper tools cooperate for defining the inner chamber 4 which is fluid-tight and capable of housing the support 40 supporting the product and the closing film 41; during said approached position, the upper and lower tool 2, 3 are configured for firmly engaging the closing film 41 with the support 40 for defining a package 40*a* for the product P. In detail, the upper tool 2 and the lower 3 comprise one or more passage holes configured for putting in fluid communication, at least in the approached position, the inner chamber 4 with the external environment or with the first and second circuit 11, 12.

The upper tool 2 comprises an inner contact surface 2*a* facing the lower tool 3 and configured for receiving the closing film 41 in contact. At the inner contact surface 2*a* (FIG. 2), the upper tool 2 comprises a plurality of through holes 15 which, as better described below, are adapted to suction gas in order to retain (or keep in contact) the closing film 41 with the inner contact surface 2*a*; in other words, the upper tool 2 is configured for defining a pressure lower than an atmospheric pressure at a volume comprised between the closing film 41 and the inner contact surface 2*a* (lower surface) of the upper tool 2 by means of the gas suction through the holes 15. As can be seen in FIGS. 2-4, the through holes are in particular in communication with the first and/or second circuit 11, 12 through channels defined within the upper tool 2 itself. As can again be seen in FIGS. 2-4, the upper tool 2 further comprises a heating device 18 configured for heating at least part of the upper tool 2, and in particular for heating the inner contact surface 2*a* of the tool 2. The heating device 18 is configured for allowing a temperature increase of the contact surface 2*a* at least in the condition in which the closing film 41 is retained by the tool itself through the through holes 15 and therefore when said film is at least partially in contact with the surface 2*a* of the upper tool 2; in this way, the heating of the inner contact surface 2*a* allows the closing film to be heated in such a way that the same can be constrained (welded) to the support. The heating device 18 is configured for heating all the contact surface 2*a* of the upper tool 2 adapted to receive in contact the film 41 in such a way that the latter can be completely and uniformly heated to be then constrained to the support 40.

The lower tool 3 is configured for supporting the support 40 supporting the product P; the support 40 may be supported at an end portion of the support 40 itself. As shown in FIGS. 2 and 3, the lower tool 3 defines a seat 3*a* inside which the support 40 is housed; also the upper tool comprises one or more through holes 25 each of which, thanks to one or more channels 26, is configured for being put in fluid communication with at least one of the first and second circuits 11, 12. As will be better described hereinafter, the through holes 25 of the lower tool 3 are configured for removing gas from the inner chamber 4 defined by the lower and upper tools in the approached position in order to define within the same chamber a pressure lower than atmospheric pressure at 20° C. and thus make vacuum packages.

FIGS. 2-4 show packaging stations 1 further comprising an auxiliary gas extraction device 17 comprising at least one needle 17*a* configured for being inserted—at least during the approached position of the upper and lower tools—within a cavity 5 defined by the closing film 41 and the support 40 (FIG. 2). The needle 17*a* is interposed between the upper tool 2 and the lower tool 3 and is configured for suctioning the gas contained between a defined inner volume between the closing film and the support. In the embodiment in which the support 40 defines a tray (see FIG. 2) comprising one or more side walls and a peripheral flange, the needle 17*a* is interposed between said peripheral flange and the closing film 41 at least in the approached position of the upper and lower tool 2, 3. The needle 17*a* is configured for being put in fluid communication with at least one of the first and second circuits 11, 12 through the channels 26 of the same lower tool. In fact, the needle 17*a* is in fluid communication with the through holes 25 of the same lower tool 3 and therefore with the seat 3*a*. The needle 17 is movable in approach and away from the chamber 4 by means of a handling system 16 shown in FIGS. 2-4. In greater detail, the needle 17*a* is configured, after having completed the suction of gas from the cavity 5 in which the same is interposed between the closing film 41 and the support 40, for being extracted from the package by the respective packaging station 1, as shown in FIG. 4.

Each packaging station 1 comprises a pressure discharge line 14 configured for putting the external environment in fluid communication with at least one selected from the group of:

- the inner chamber 4 defined by the upper and lower tools in the approached position;
- the volume defined between the closing film 41 and the contact surface 2*a* of the upper tool.

The discharge line 14 may comprise a discharge conduit and at least one control valve 20 configured for controlling the passage of fluid through said discharge conduit. Furthermore, each packaging station 1 may comprise a sensor configured for emitting at least one signal representative of at least one parameter comprising at least one of:

- a pressure present in the inner chamber 4;
- a temperature of the upper tool, in particular a temperature of the inner contact surface 2*a* of the upper tool;
- a relative position of the upper and lower tools;
- a presence of a support 40 supporting a product P within the respective packaging station;
- a presence of a closing film 41 at the respective packaging station 1.

As mentioned above, the plant 100 comprises a vacuum pump 50 which is connected to each packaging station 1 by the first circuit 11; the pump is configured for suctioning gas from one or more packaging stations 1 in order to allow the suction of gas into the inner chamber 4 for the production of vacuum packages and/or the suction of gas from the upper tool in order to allowing the retention of the closing film 41. The vacuum pump 50 may be of the rotary or reciprocating type; in particular, the rotary vacuum pump comprises an impeller connected either directly or through the interposition of a mechanical transmission to a motor configured for imposing a rotary motion on the impeller itself. Alternatively, the vacuum pump is of the reciprocating motion type, having one or more pistons also connected to a motor. The motor, connected to the rotary vacuum or reciprocating motion pump, is an electric motor powered by a direct or alternating current. The motor is controlled in such a way as to be able to adjust its rotation speed so as to vary the suction pressure of the vacuum pump and/or the flow rate of the suctioned working fluid. The fluid suction pressure and/or flow rate can also be changed by modifying one or more geometrical parameters of the impeller, in the case of a rotary vacuum pump, or by using one or more choke valves. The vacuum pump 50 may comprise at least one detection sensor configured for emitting a signal representative of a pressure at an intake section of the vacuum pump 50 itself.

As described above, the plant 100 comprises the first circuit 11 which connects the vacuum pump 50 with each packaging station 1. The first circuit 11 comprises a primary line 11*a* placed in common to the plurality of packaging stations 1 and a plurality of secondary lines 11*b* each of which connects the primary line 11*a* of the first circuit 11 with a respective packaging station 1. In detail, the upper and lower tools 2, 3 of each packaging station 1 are connected to the primary line 11*a* of the first circuit 11 by means of a respective secondary line 11*b* of the first circuit 11. Even more in detail, each secondary line 11*b* comprises a first branch which connects the upper tool 2 with the primary line 11*a* and a second branch, distinct from the first branch, which connects the lower tool 3 with the primary line 11*a*. In fact, the first branch is connected to the channels 2*b* of the upper tool 2 and thus with the through holes 15 of the latter; the first branch of the secondary line 11*b* is configured for putting the through holes 15 of the upper tool in fluid communication with the primary line 11*a* of the first circuit 11. In this way, through the first branch of the secondary line 11*b* it is possible to retain the closing film 41 in such a way that the latter can remain—during gas suction from said first branch—in contact with the inner contact surface 2*a* of the upper tool 2. The second branch of the second line 11*b* is instead connected to the channels 26 of the lower tool 3 and thus with the through holes 25 of the same tool 3 and/or with the gas suction needle 17*a*; the second branch of the secondary line 11*b* is configured for putting in fluid communication the holes 25 of the lower tool 3 and/or the needle 17*a* with the primary line 11*a* of the first circuit 11. In this way, through the second branch of the secondary line 11*b* it is possible to extract gas from the inner chamber 4 and consequently from the cavity 5 defined by the closing film 41 in cooperation with the support so as to be able to define vacuum packs. Each of said first and second branches of the secondary line 11*b* comprises a respective control valve 20 configured for enabling or interdicting the fluid communication between the primary line 11*a* of the first circuit 11 and the respective lower or upper tool 2, 3. The plant 100 may comprise a pressure sensor active on the first circuit 11 configured for emitting a signal representative of a pressure inside the latter and in particular a pressure at at least one secondary line 11*b*. In one embodiment, the plant 100 comprises a sensor for each secondary line 11*b* and one for the primary line 11*a* of the first circuit 11. The plant 100 may further comprise at least one flow sensor configured for emitting a signal representative of a flow of gas passing through the first circuit 11, in particular when passing from at least one secondary line 11*b*.

As described above, the plant 100 further comprises an auxiliary pressure device 51 which is placed in connection with each packaging station 1 by means of the second circuit 12, as shown in the accompanying FIGS. 5 to 14. As for the first circuit 11, the second circuit 12 comprises at least one primary line 12*a* in common to the plurality of packaging stations 1 and a plurality of secondary lines 12*b* each of which connects the primary line 12*a* of the second circuit 11 with a respective packaging station 1. In detail, the upper and lower tools 2, 3 of each packaging station 1 are connected to the primary line 12*a* of the second circuit 12 by means of a respective secondary line 11*b* of the second circuit 12. Even more in detail, each secondary line 12*b* comprises a first branch which connects the upper tool 2 with the primary line 12*a* and a second branch, distinct from the first branch of the secondary line 12*b*, which connects the lower tool 3 with the primary line 12*a*. In fact, the first branch of the secondary line 12*b* is connected to the channels 2*b* of the upper tool 2 and thus with the through holes 15 of the latter; the first branch of the secondary line 12*b* is configured for putting the through holes 15 of the upper tool 2 in fluid communication with the primary line 12*a* of the second circuit 12. In this way, through the first branch of the secondary line 12*b* it is possible to retain the closing film 41 in such a way that the latter can remain—during gas suction from said first branch—in contact with the inner contact surface 2*a* of the upper tool 2. The second branch of the second line 12*b* is instead connected to the channels 26 of the lower tool 3 and thus with the through holes 25 of the same tool 3 and/or with the gas suction needle 17*a*; the second branch of the secondary line 12*b* is configured for putting in fluid communication the holes 25 of the lower tool 3 and/or the needle 17*a* with the primary line 12*a* of the second circuit 12. In this way, through the second branch of the secondary line 12*b* it is possible to extract gas from the inner chamber 4 and consequently from the cavity 5 defined by the closing film 41 in cooperation with the support so as to be able to define vacuum packs. Each of said first and second branches of the secondary line 12*b* may comprise a respective control valve 20 configured for enabling or inhibiting the fluid communication between the primary line 12*a* of the second circuit 12 and the respective lower or upper tool 2, 3. The plant 100 may comprise a pressure sensor active on the second circuit 12 configured for emitting a signal representative of a pressure inside the latter and in particular a pressure at at least one secondary line 12*b*. In one embodiment, the plant 100 comprises a sensor for each secondary line 12*b* and one for the primary line 12*a* of the second circuit 12. The plant 100 may further comprise at least one flow sensor configured for emitting a signal representative of a flow of gas passing through the second circuit 12, in particular when passing from at least one secondary line 12*b*.

The first and second circuit 11, 12 are placed in parallel with each other and are configured for respectively connecting the vacuum pump 50 and the pressure auxiliary device 51 to each packaging station 1 and to allow the suction of gas from said station 1. In the embodiment shown schematically in FIGS. 5-14, each of said first and second circuit 11, 12 comprises a plurality of control valves 20. Each control valve 20 is configured for defining, independently of the other, at least one passage condition in which the control valve 20 allows fluid to pass through it and at least one closure condition in which the control valve 20 prohibits the transit of fluid through it. The control valves 20 can be controlled between the passage condition and the closure condition by an automatic actuation, in particular by means of a predetermined electric control. In detail, each secondary line 11*b* of the first circuit 11 comprises at least one control valve 20 configured for enabling or interdicting the fluid communication between the primary line 11*a* of the first circuit 1 and the respective packaging station 1 and thus with the vacuum pump 50. In particular, a control valve 20 is present on each of said first and second branches of each secondary line 11*b* so that the fluid communication between the vacuum pump and the upper tool can be independently controlled between: the vacuum pump and the lower tool, the vacuum pump and the upper tool. Moreover, each secondary line 12*b* of the second circuit 12 comprises at least one control valve 20 configured for enabling or interdicting the fluid communication between the primary line 12*a* of the second circuit 12 and the respective packaging station 1 and thus with the auxiliary pressure device 51. In particular, a control valve 20 is present on each of said first and second branches of each secondary line 12*b* in such a way that the fluid communication can be independently controlled between:

the auxiliary pressure device 51 and the upper tool;

the auxiliary pressure device 51 and the lower tool.

As regards the auxiliary pressure device 51, the latter may comprise, in an embodiment, a reservoir configured for housing a fluid having a pressure lower than an atmospheric pressure measured at 20° C. Further, the pressure auxiliary device 51 may be a section of the second circuit 12 itself defining a volume configured for housing a fluid having a pressure lower than an atmospheric pressure measured at 20° C. Alternatively, the pressure auxiliary device 51 may comprise a vacuum pump distinct from the pump 50 and of the type described above. The auxiliary pressure device 51 is configured for suctioning a gas through the second circuit 12, from at least one of said packaging stations 1. The plant 100 may comprise a pressure sensor configured for emitting a signal representative of a pressure inside the auxiliary pressure device 51. In the configuration in which the auxiliary pressure device 51 comprises a reservoir or a volume of the second circuit 12, the plant 100 may comprise a third circuit 13 configured for putting in fluid communication the vacuum pump 50 with the device 51. In particular, the third circuit 13 is configured for putting in fluid communication the primary line 11*a* of the first circuit 11 with the primary line 12*a* of the second circuit 12 and comprises at least one control valve 20 adapted to enable or inhibit the passage of gas between the reservoir of the device 51 and the vacuum pump 50. The plant 100 may comprise at least one pressure sensor configured for emitting a signal representative of a pressure inside the third circuit 51 itself. The presence of the third circuit 13 allows the vacuum pump 50 to suction gas from the reservoir of the auxiliary pressure device 51 so that inside the latter there is a pressure lower than an atmospheric pressure measured at 20° C. The reservoir is therefore configured for housing and, depending on the operating conditions of the plant 100, maintaining a pressure lower than an atmospheric pressure measured at 20° C. The auxiliary pressure device 51 can then be used for housing gases from the second circuit 12 and therefore from the various packaging stations 1. At the structural level, the first 11, the second 12 and the third circuit 13 comprise a plurality of fluid-tight conduits configured for allowing the transit of gas.

Figure 5:
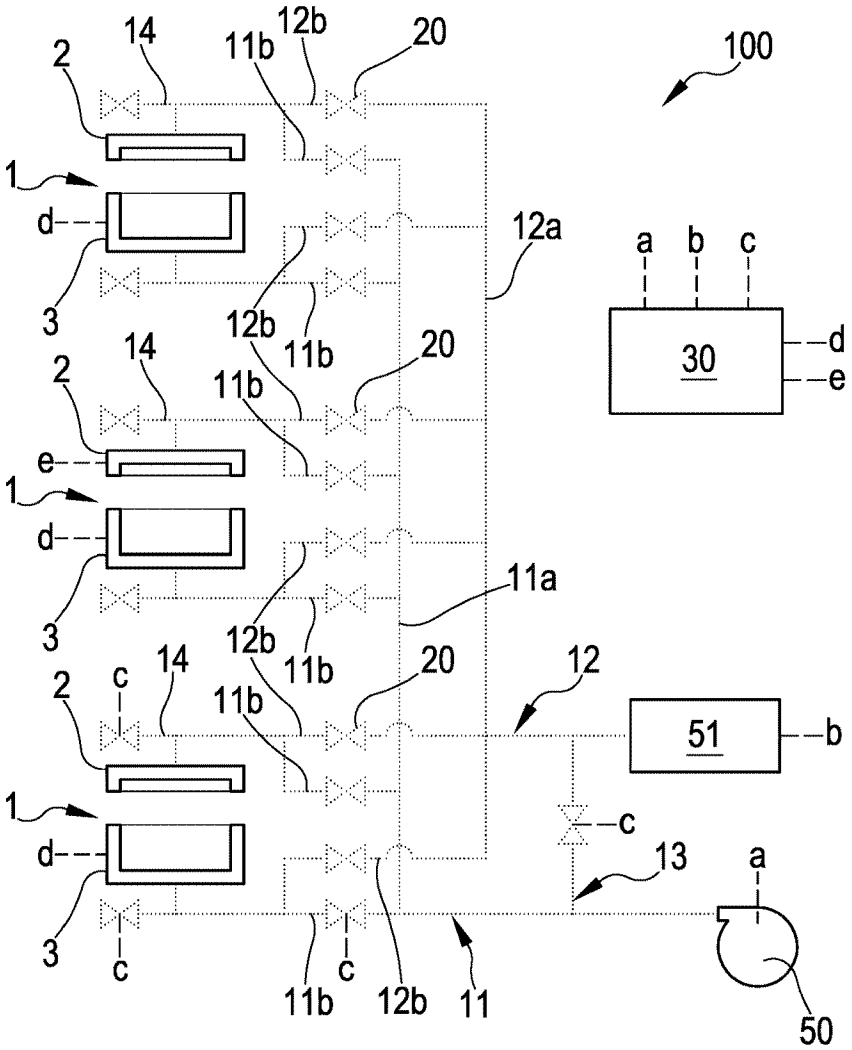

The plant 100 may further comprise a control unit 30 schematically shown in FIG. 5 which is connected to one or more control valves 20, in particular with all the control valves 20 of the first circuit 11, of the second circuit 12 and of the third circuit 13. The control unit 30 is configured for controlling each control valve 20 independently of the passage condition and the closure condition for enabling or inhibiting the fluid communication. In particular, the control valves 20 of the first circuit 11 are controlled by the control unit 30 independently of the passage condition and the closure condition for enabling or inhibiting the fluid communication between at least one of said packaging stations 1 and the vacuum pump 50. Furthermore, the control valves 20 of the second circuit 12 are controlled by the control unit 30 independently between the passage condition and the closure condition for enabling or inhibiting the fluid communication between at least one of said packaging stations 1 and the auxiliary pressure device 51. In one embodiment, the control unit 30 is further connected to the at least one control valve 20 of the third circuit 13 and is configured for controlling said valve 20 between the passage condition and the closure condition for enabling or inhibiting the fluid communication between the vacuum pump 50 and the auxiliary pressure device 51. The control unit 30 in addition to independently operating the valves 20 of a same circuit is further configured for independently controlling the closure and passage conditions of all the control valves 20 of the plant 100. The control unit 30 is also connected to all the sensors of the plant 100 for receiving the respective representative signal emitted by the detecting sensor itself. In particular, the control unit 30 is configured for receiving in input a signal representative of at least one parameter selected from the group of:

- a pressure present in the first circuit;
- a pressure present in the second circuit;
- a pressure present in the third circuit;
- a pressure present in a section of the vacuum pump;
- a pressure present in a section of the auxiliary pressure device;
- a temperature of the upper tool of each packaging station;
- a flow rate of gas passing through the first circuit;
- a flow of gas passing through the second circuit;
- a flow of gas passing through the third circuit;
- a relative position of the upper and lower tools of each packaging station;
- the presence of a support 40 and/or of the closing film 41 at each packaging station 1;
- the passage or closure condition of the control valves 20 of the plant;
- a predetermined actuation sequence of the plurality of control valves 20 of the first and second circuits 11, 12 and optionally of the third circuit 13, between the passage condition and the closure condition. Said signal representative of a predetermined actuation order of the control valves 20 may be, for example, a sequential order of opening and closing of each control valve 20, independently of each other, as a function of a time parameter.

The control unit 30 is then configured for determining at least one value of at least one of the parameters just mentioned and, as a function of said determined value, define the passage or closure condition of at least one control valve 20 of the first and/or second circuit 11, 12, and optionally of the third circuit 13. In other words, the control unit 30 is configured for defining a plurality of work conditions, shown in FIGS. 5 to 14, defining different configurations of the plant 100 in which the control valves 20 enable or inhibit the fluid communication between the packaging stations 1, the vacuum pump 50 and the auxiliary pressure device 51.

FIG. 5 shows a configuration of the plant 100 in which the vacuum pump 50, the packaging stations 1 and the auxiliary pressure device 51 are not in communication with each other. In particular, the control unit 30 defines a closure condition of the control valves 20 arranged on the first, second and third circuit 11, 12, 13.

Figure 6:
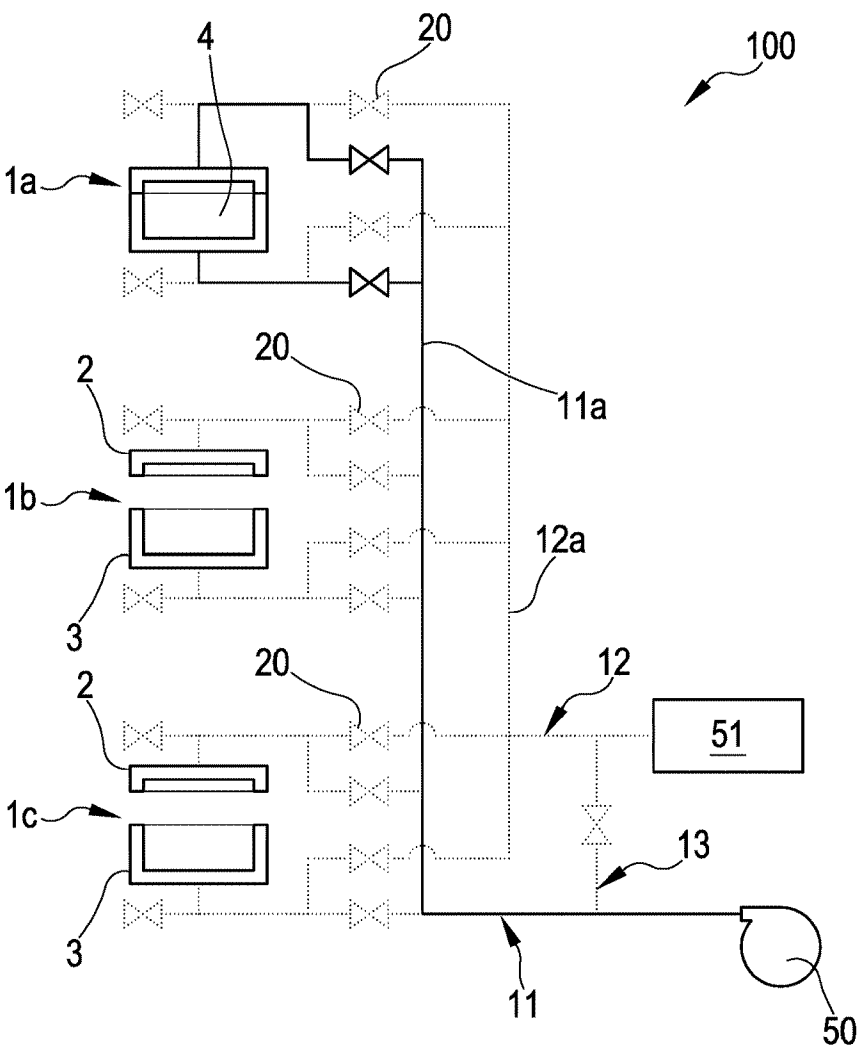
FIGS. 5 to 14 are respective schematic views of different operating conditions of a packaging plant according to the present invention.

FIG. 6 instead shows a configuration of the plant 100 defining a work condition in which the vacuum pump 50 is put in fluid communication with at least a first packaging station 1*a*, the latter having the upper and lower tool 2, 3 in an approached position. In particular, the control valves 20 of the first and second branches of the secondary line 11*b* of the first circuit relative to said first packaging station 1*a* are arranged in a passage condition while the control valves 20 of the secondary lines of the remaining packaging stations are arranged in a closure condition. Moreover, the control valve 20 of the third circuit 13 is arranged in the closure condition. FIG. 6 shows a particular case in which the vacuum pump 50 is placed in fluid communication with a single first packaging station 1*a*. In said work condition, the vacuum pump 50 is placed in fluid communication with:

- the holes 26 of the lower tool and/or the suction needle 17*a*. The pump 50 is dedicated solely to a single packaging station and is adapted to suction gas from the chamber 4 for the production of a vacuum pack;
- the through holes 15 of the upper tool in such a way that the action of the vacuum pump allows retaining the closing film in contact with the surface 2*a* of the upper tool 2. As described above, during the film holding condition, the upper tool is also designed to heat the closing film so that it can be bonded (thermo-welded) to the support.

Figure 7:
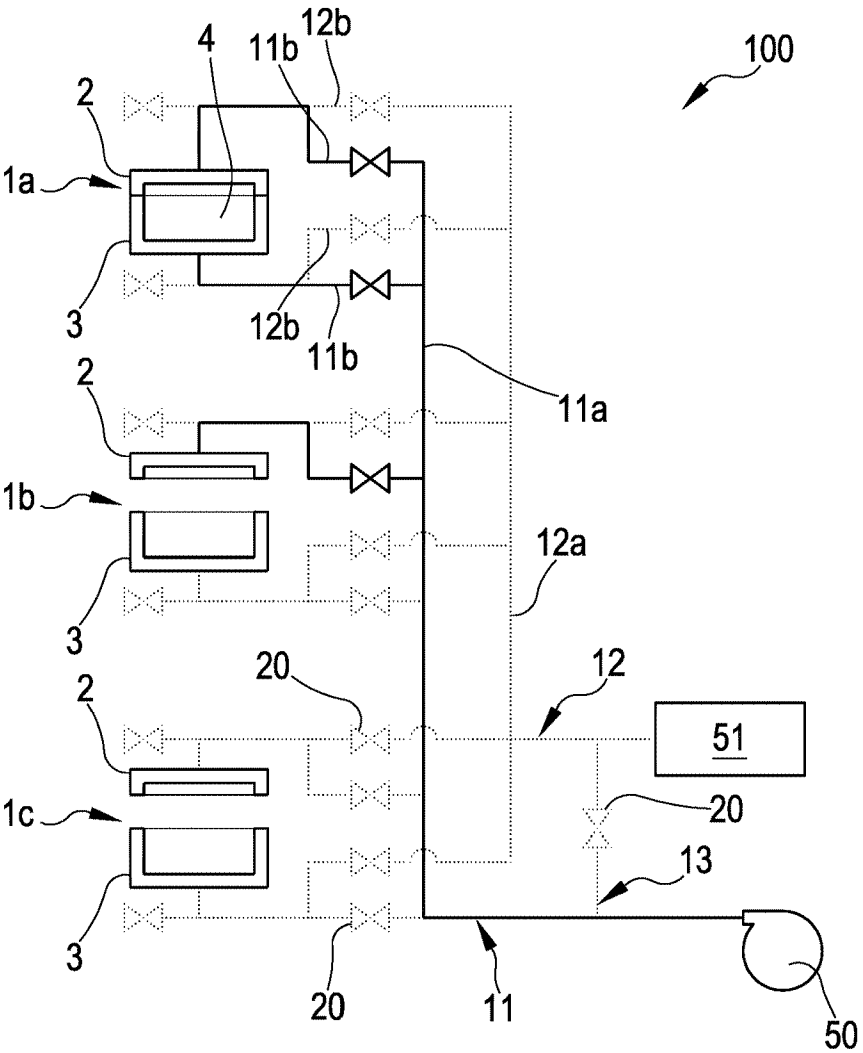

FIG. 7 shows a configuration of the plant 100 defining a work condition in which the vacuum pump 50 is in fluid communication with the upper and lower tool 2, 3 of a first packaging station 1*a* and with the upper tool 2 of at least a second packaging station 1*b*. In particular, the control unit 30 defines a condition for the passage of the control valves 20 arranged on the first and second branch of the secondary line 11*b* of the first circuit 11 relative to said at least a first packaging station 1*a*. The at least one first packaging station 1*a* (FIG. 7 shows a particular case in which there is a single first packaging station 1*a*), has the upper and lower tool 2, 3 arranged in an approached condition such that in the inner chamber 4, a pressure lower than the atmospheric pressure measured at 20° C. can be defined.

The vacuum pump 50 in the configuration in FIG. 7 also defines a pressure lower than the atmospheric pressure measured at 20° C. within a volume comprised between a closing film 41 in contact with the upper tool 2 of the first packaging station 1*a* and the upper tool 2 itself so as to retain the closing film 41 and place the latter in contact with the upper tool 2. The closing film 41, in contact with said upper tool 2, is then heated by means of the heating device 18 so as to soften the closing film 41 itself as described above. Moreover, the control unit 30 defines a passage condition of the control valves 20 arranged on the first branch of the secondary line 11*b* of the first circuit 11 relative to a second packaging station 1*b* to allow the fluid communication between the vacuum pump 50 and the upper tool 2 of the corresponding second packaging station 1*b*. In the particular case shown in FIG. 7, the vacuum pump 50 is in fluid communication with the upper tool 2 of a single second packaging station 1*b* so as to define a pressure lower than the atmospheric pressure measured at 20° C. within a volume comprised between a closing film 41 in contact with the upper tool 2 of the second packaging station 1*b* and the upper tool 2 itself so as to retain the closing film 41 and place the latter in contact with the upper tool 2 of the second packaging station 1*b*. In fact, in the configuration in FIG. 7, the vacuum pump 50 is active on the packaging station 1*a* for suctioning air from the chamber 4 and at the same time is active on the upper tool of a second packaging station 1*b* for retaining the closing film 41 in contact with the contact surface 2*a*.

Figure 8:
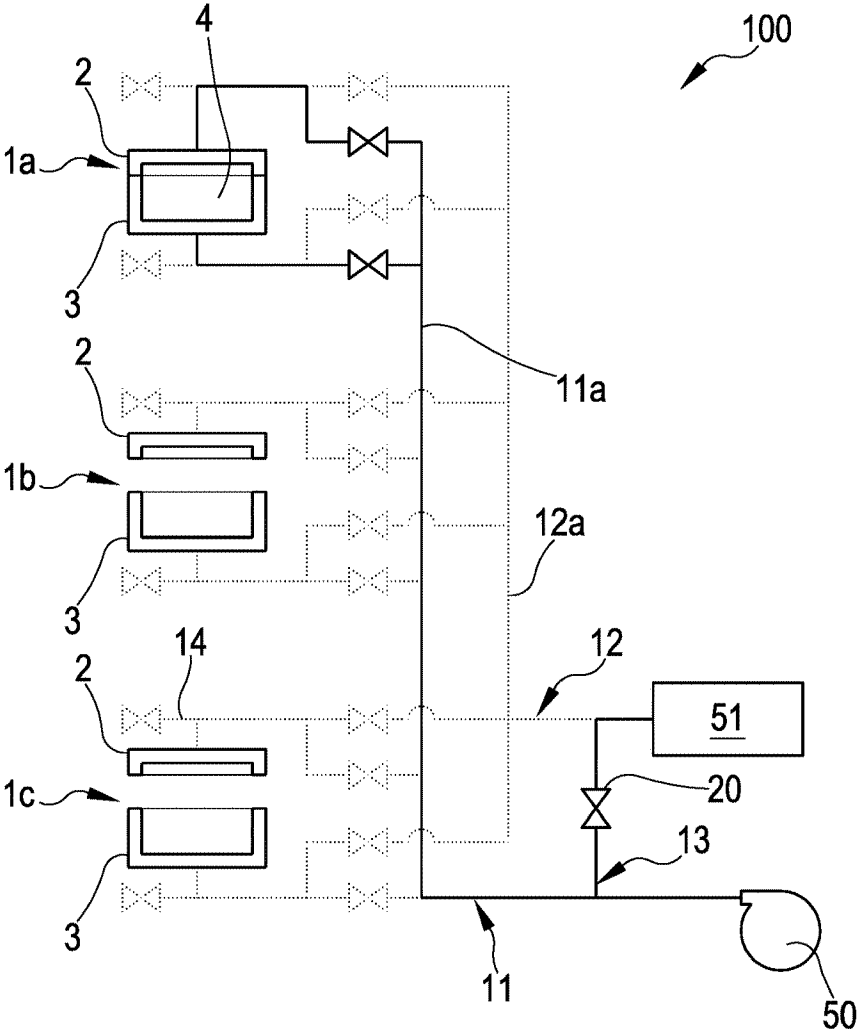

FIG. 8 shows a configuration of the plant 100 defining a second work condition in which the vacuum pump 50 is in fluid communication with the upper and lower tool 2, 3 of at least a first packaging station 1*a*. In particular, the control unit 30 defines a condition for the passage of the control valves 20 arranged on the first and second branch of the secondary line 11*b* of the first circuit 11 relative to said at least a first packaging station 1*a*. The at least one first packaging station 1*a* (FIG. 8 shows a particular case in which there is a single first packaging station 1*a*), has the upper and lower tool 2, 3 arranged in an approached condition such that the pump 50 may define, in the inner chamber 4, a pressure lower than the atmospheric pressure measured at 20° C. can be defined. The vacuum pump 50 may also define a pressure lower than the atmospheric pressure measured at 20° C. within a volume comprised between a closing film 41 in contact with the upper tool 2 of the first packaging station 1*a* and the upper tool 2 itself so as to retain the closing film 41 and place the latter in contact with the upper tool 2. Moreover, in the configuration of the plant illustrated in FIG. 8, the control unit 30 defines a passage condition of the control valve 20 arranged on the third circuit 13 to allow the fluid communication between the vacuum pump 50 and the reservoir of the auxiliary pressure device 51 so as to define within it a pressure lower than an atmospheric pressure measured at 20° C.

Figure 9:
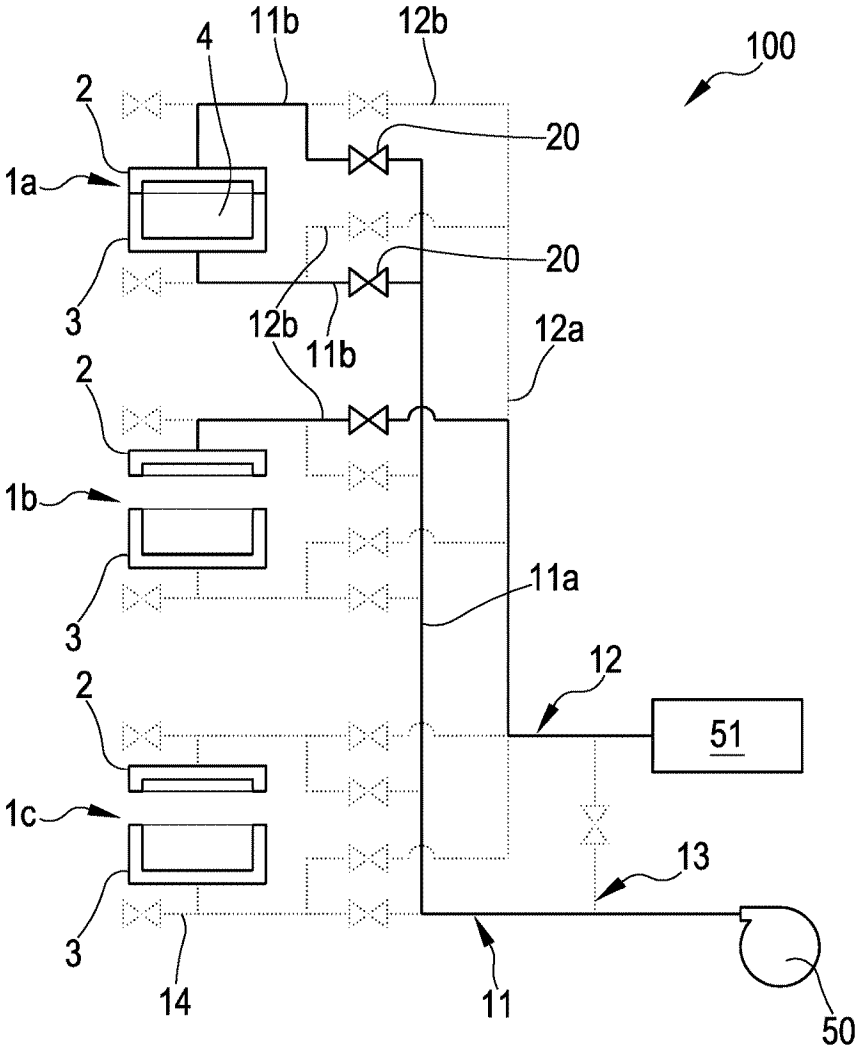

FIG. 9 shows a configuration of the plant 100 defining a first work condition in which the vacuum pump 50 is in fluid communication with the upper and lower tool 2, 3 of at least a first packaging station 1*a*. In particular, the control unit 30 defines a condition for the passage of the control valves 20 arranged on the first and second branch of the secondary line 11*b* of the first circuit 11 relative to said at least a first packaging station 1*a*. The at least one first packaging station 1*a* (FIG. 9 shows a particular case in which there is a single first packaging station 1*a*), has the upper and lower tool 2, 3 arranged in an approached condition so as to define, in the inner chamber 4, a pressure lower than the atmospheric pressure measured at 20° C. can be defined. The vacuum pump 50 also defines a pressure lower than the atmospheric pressure measured at 20° C. within a volume comprised between a closing film 41 in contact with the upper tool 2 of the first packaging station 1*a* and the upper tool 2 itself so as to retain the closing film 41 and place the latter in contact with the upper tool 2. Moreover, the control unit 30 defines a passage condition of the control valves 20 arranged on the first branch of the secondary line 12*b* of the second circuit 12 relative to at least a second packaging station 1*b* to allow the fluid communication between the auxiliary pressure device 51 and the respective upper tool 2 of the second packaging station 1*b*. In the particular case shown in FIG. 9, the auxiliary pressure device 51 is in fluid communication with the upper tool 2 of a single second packaging station 1*b* so as to define a pressure lower than the atmospheric pressure measured at 20° C. within a volume comprised between a closing film 41 in contact with the upper tool 2 of the second packaging station 1*b* and the upper tool 2 itself so as to retain the closing film 41 and place the latter in contact with the upper tool 2. In said first work condition, the auxiliary pressure device 51 may be a reservoir having therein a pressure lower than an atmospheric pressure measured at 20° C. defined during the work condition illustrated in FIG. 8.

Figure 10:
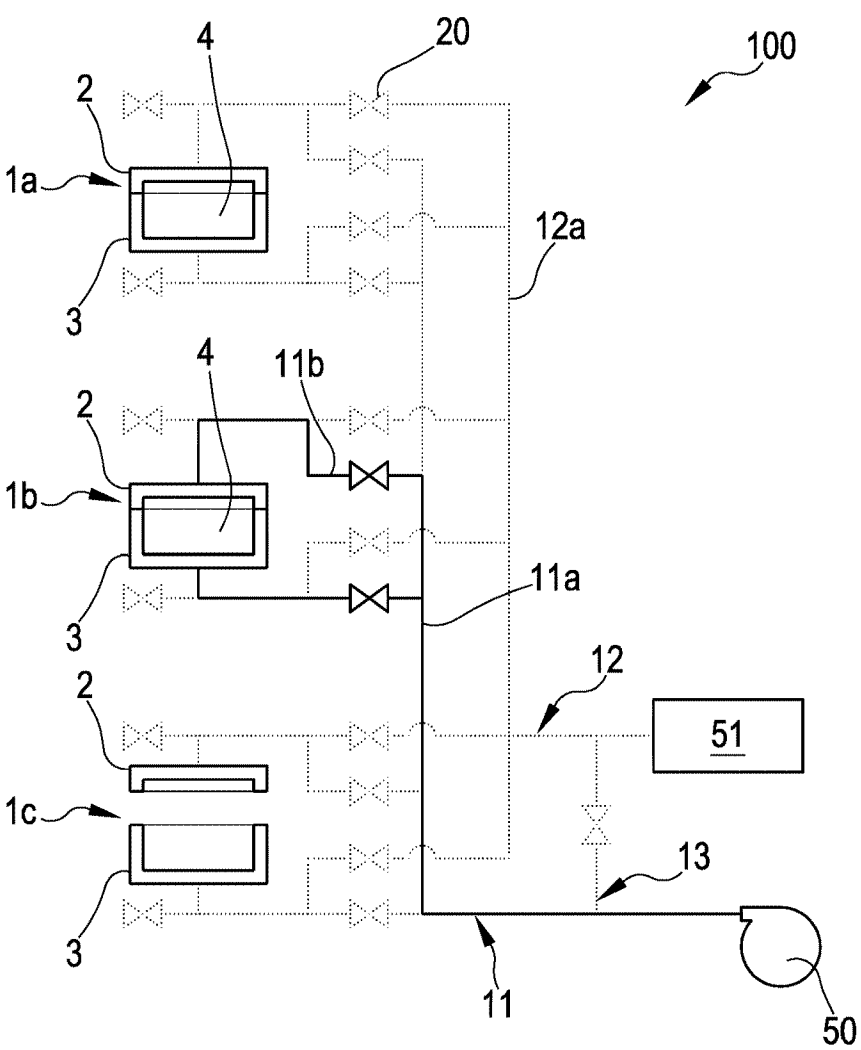

FIG. 10 shows a configuration of the plant 100 defining a work condition in which the vacuum pump 50 is in fluid communication with the upper and lower tool 2, 3 of at least a second packaging station 1*b*. Furthermore, the at least one first packaging station 1*a* has therein a pressure lower than an atmospheric pressure measured at 20° C. defined during the preceding work conditions. The control unit 30 defines a closure condition of the control valves 20 arranged on the first and second branch of the secondary line 11*b* of the first circuit 11 relative to said at least a first packaging station 1*a* for preventing fluid communication between the vacuum pump 50 and said first packaging station 1*a*. Moreover, the control unit 30 defines a closure condition of the control valves 20 arranged on the first and second branch of the secondary line 12*b* of the second circuit 12 relative to said at least a first packaging station 1*a* to inhibit the fluid communication between the auxiliary pressure device 51 and said first packaging station 1*a*. In addition, also the control valves of the discharge line 14 relative to the first packaging station are arranged in a closure condition so as to hermetically isolate the inner chamber 4 of the packaging station 1*a* from the external environment.

Figure 11:
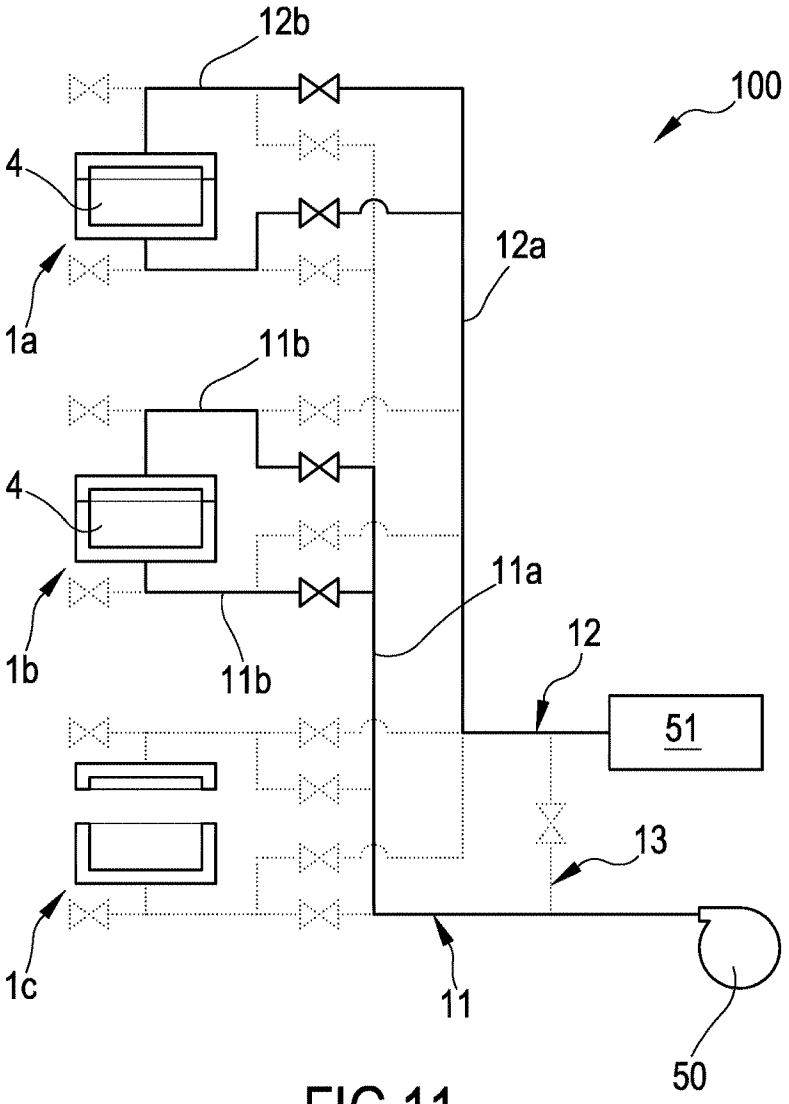

FIG. 11 shows a configuration of the plant 100 defining a third work condition in which the vacuum pump 50 is in fluid communication with the upper and lower tool 2, 3 of at least a second packaging station 1*b*. In particular, the control unit 30 defines a condition for the passage of the control valves 20 arranged on the first and second branch of the secondary line 11*b* of the first circuit 11 relative to said at least a second packaging station 1*b*. The at least one second packaging station 1*b* (FIG. 11 shows a particular case in which there is a single second packaging station 1*b*), has the upper and lower tool 2, 3 arranged in an approached condition so as to define, in the inner chamber 4, a pressure lower than the atmospheric pressure measured at 20° C. can be defined. The vacuum pump 50 also defines a pressure lower than the atmospheric pressure measured at 20° C. within a volume comprised between a closing film 41 in contact with the upper tool 2 of the first packaging station 1*a* and the upper tool 2 itself so as to retain the closing film 41 and place the latter in contact with the upper tool 2. Moreover, the control unit 30 defines a passage condition of the control valves 20 arranged on the first and/second branch of the secondary line 12*b* of the second circuit 12 relative to the at least a first packaging station 1*a* to enable the fluid communication between the reservoir of the auxiliary pressure device 51 and said first packaging station 1*a*. In said third work condition, the first packaging station 1*a* has therein a pressure, defined during preceding work conditions, adapted for the packaging of the product, lower than a pressure present inside the reservoir of the auxiliary pressure device 51. This causes a passage of gas from the reservoir of the auxiliary pressure device 51 towards said first packaging station 1*a* and, consequently, causes a reduction in the pressure present inside the reservoir of the auxiliary pressure device 51. In this way, the depressurization present inside the first packaging station 1*a* is at least partially recovered by the reservoir of the auxiliary pressure device 51, which is depressurized without further engaging the vacuum pump 50, the latter engaged in the packaging operations, inside the at least one second packaging station 1*b*. At the end of the pressure recovery step by the reservoir of the device 51, the control unit is configured for operating (opening) the valve 20 arranged on the discharge line 14 of the packaging station in order to put said packaging station in communication with the external environment.

Figure 12:
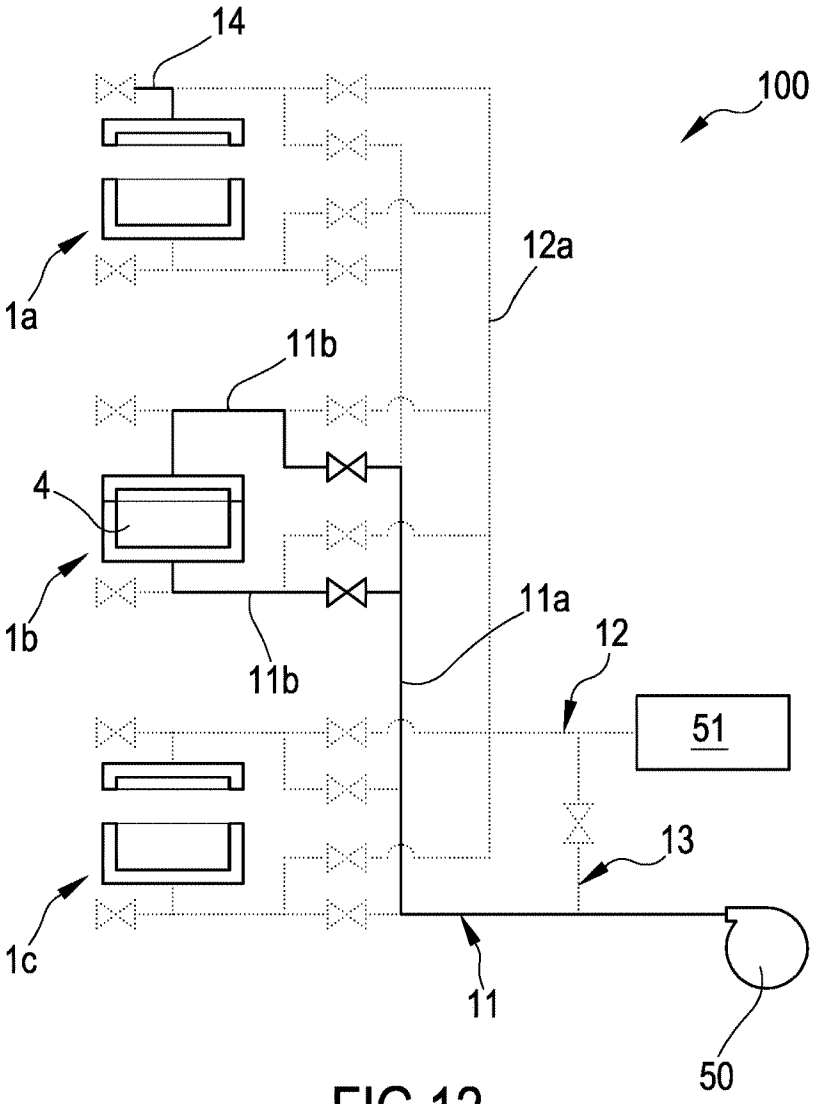

FIG. 12 shows a configuration of the plant 100 subsequent to the third work condition in which the control unit 30 is configured for controlling in a passage condition the control valve 20 of the discharge line 14 connected to the at least one first packaging station 1*a* so as to put in fluid communication the inner chamber 4 of said first packaging station 1*a* with the external environment.

Figure 14:
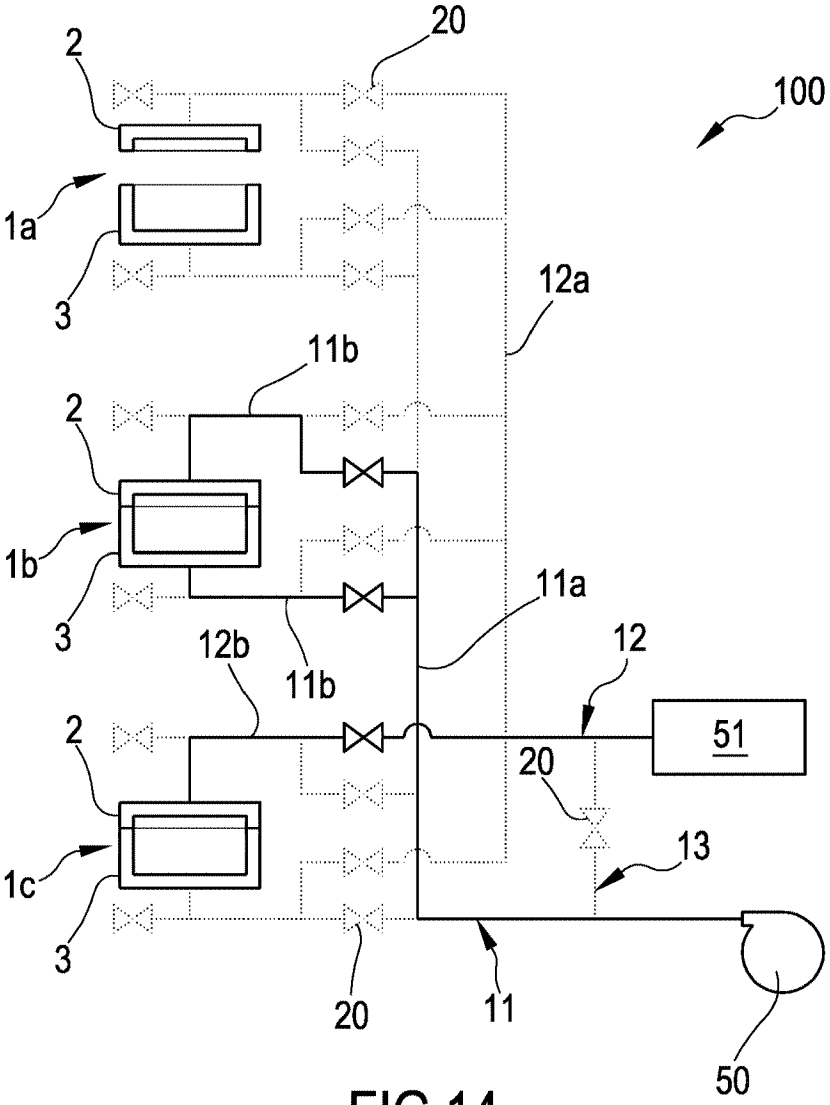
Figure 13:
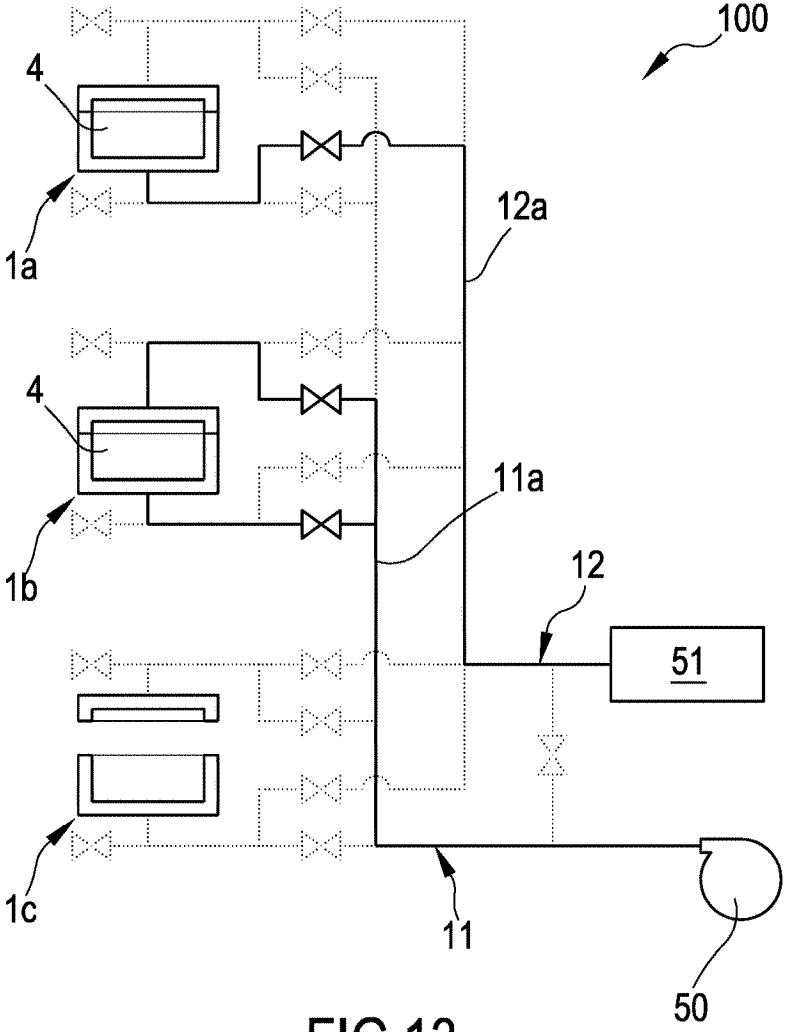

FIGS. 13 and 14 show further configurations of the plant 100 in which the same operations described above are repeated at further packaging stations. By way of example in FIG. 13, the control unit 30 defines a condition for the passage of the control valves 20 arranged on the first and second branch of the secondary line 11*b* of the first circuit 11 relative to the at least one second packaging station 1*b*. The at least one second packaging station 1*b* (FIG. 13 shows a particular case in which there is a single second packaging station 1*b*), has the upper and lower tool 2, 3 disposed in an approached condition so as to define, within the inner chamber 4, a pressure lower than the atmospheric pressure measured 20° C. Furthermore, the control unit 30 defines a condition of passage of the control valves 20 arranged on the second branch of the secondary line 12*b* of the second circuit 12 relative to at least a first packaging station 1*a* to allow fluid communication between the auxiliary device of pressure 51 and the respective lower tool 3 of the first packaging station 1*a*. In the particular case shown in FIG. 13, the auxiliary pressure device 51 is in fluid communication with the lower tool 2 of a single first packaging station 1*a* so as to define a pressure lower than the atmospheric pressure measured at 20° C. in the inner chamber 4 of the packaging station 1*a*. In this work condition, the auxiliary pressure device 51 may be a reservoir having therein a pressure lower than an atmospheric pressure measured at 20° C. defined during a preceding work condition by, for example, the vacuum pump 50 through the third circuit 13 (see FIG. 8) or by the depressurization recovery operation of a respective packaging station (see FIG. 11 corresponding to the third work condition). By way of example in FIG. 14, the control unit 30 defines a condition for the passage of the control valves 20 arranged on the first and second branch of the secondary line 11*b* of the first circuit 11 relative to the at least one second packaging station 1*b*. The at least one second packaging station 1*b* (FIG. 14 shows a particular case in which there is a single second packaging station 1*b*), has the upper and lower tool 2, 3 disposed in an approached condition so as to define, within the inner chamber 4, a pressure lower than the atmospheric pressure measured 20° C. Furthermore, the control unit 30 defines a condition of passage of the control valves 20 arranged on the first branch of the secondary line 12*b* of the second circuit 12 relative to at least a third packaging station 1*c* to allow fluid communication between the auxiliary device of pressure 51 and the respective upper tool 3 of the third packaging station 1*c*. In the particular case shown in FIG. 14, the auxiliary pressure device 51 is in fluid communication with the upper tool 2 of a single third packaging station 1*c* so as to define a pressure lower than the atmospheric pressure measured at 20° C., within a volume comprised between a closing film 41 in contact with the upper tool 2 of the third packaging station 1*c* and the upper tool 2 itself so as to retain the closing film 41 and place the latter in contact with the upper tool 2. In this work condition, the auxiliary pressure device 51 may be a reservoir having therein a pressure lower than an atmospheric pressure measured at 20° C. defined during a preceding work condition by, for example, the vacuum pump 50 through the third circuit 13 (see FIG. 8) or by the depressurization recovery operation of a respective packaging station (see FIG. 11 corresponding to the third work condition).

In principle, the vacuum pump 50 operating on the first circuit 11 is used for the suction of air from the upper tool 2 of a packaging station (to retain the closing film in contact with the surface 2*a* of the upper tool 2) and for the suction of gas from the lower tool 3 in order to remove gas from the inner chamber 4 defined by the cooperation between the lower and upper tool and thus by the cavity 5 defined between the support 40 and the closing film 41. The auxiliary pressure device 51 represents a further device for suctioning gas from the packaging stations.

As mentioned above, the plant 100 may comprise a plurality of stations 1 arranged side-by-side, as shown in FIG. 1; in this configuration, the plant 100 may further comprise a conveyor 302 configured for moving a plurality of supports 40 or trays along a predetermined advancement path at the plurality of packaging stations 1. The conveyor 302 may comprise a belt driven by one or more electric motors and configured for supporting the supports 40. FIG. 1 shows a configuration of the plant 100, for the sole purpose of representing one of the possible arrangements of the devices being part of the plant 100. In this regard, in a further embodiment, it is possible to have a conveyor 302 for each of the packaging stations 1, the latter not arranged consecutively.

In the accompanying figures, a plant 100 has been shown in which a plurality of preformed supports 40 are moved on the belt (conveyor 302) and brought at the respective packaging station 1. Prior to the positioning of the support on the lower tool 3 and then inside the packaging station 1, the loading of the product P onto the support is provided. This loading action can be carried out manually by an operator or it can be carried out automatically by product loading stations located upstream of the packaging stations.

As can be seen in FIG. 1, each packaging station comprises a respective feeding group 303 configured for providing the closing film 41 and dispose it at each of the packaging stations 1, in particular at the upper tool 2 of each packaging station 1. The supplying assembly 303 provides that the closing film 41 is wound on a reel movable by rotation, in particular said reel can be: a) moved by an electric motor, b) braked, c) free in rotation. The control unit 30 is also configured for synchronizing the operations of the conveyor 302 and the feeding group 303 with the operation of the packaging stations and with those of the vacuum pump and of the auxiliary device 51.

Packaging Process

Also forming the object of the present invention is a process of packaging by using a plant 100 according to the present invention and according to one or more of the appended claims and/or according to the above-reported detailed description. The process involves at least one packaging step performed in at least one first station 1*a*. Before being able to perform such a packaging step, the process involves a step of preparation of the first station 1*a* comprising the positioning of the support 40 supporting the product P on the lower tool and the positioning of the closing film 41 between said lower and upper tool.

The packaging step preliminarily provides for a holding step of the film 41 by the suction of gas through the upper tool 2. In particular during this preliminary film holding step, the vacuum pump 50 through the main line 11*a*, and the first branch of the secondary line 11*b* suctions air from the through holes 15 of the upper tool 2 of the station 1*a*; in this way, the air removal action allows the film 41 to contact the surface 2*a* of the upper tool 2. Specifically, this holding step provides for the suction, through the passage holes 15, of gas from the volume between the closing film 41 and the contact surface 2*a* of the upper tool 2. During the holding step of the closing film, the upper tool 2 is heated by means of the heating device 18.

Still during the packaging step carried out by the station 1*a*, the upper and lower tools 3 are placed in the approached position to define the fluid-tight inner chamber 4. The film holding and heating steps can be carried out before, during or after the displacement of the lower and upper tools from the distal to the approached position.

Following the formation of the inner chamber 4, the packaging step provides for the suction of gas from the lower tool 3 of the station 1*a* by the second branch of the secondary line 11*b* of the first circuit 11: this branch is in connection with the vacuum pump in such a way that the latter can suction gas from the chamber 4 and define within it a pressure lower than an atmospheric pressure measured at 20° C. This step is shown schematically in FIG. 6, in which the first packaging station 1*a* is in fluid communication with the vacuum pump 50. After starting the gas suction step from the lower tool of the first station 1*a*, the packaging step provides for the release of the closing film 41 from the upper tool 2 so that the same film 41 can reach the support and close the product to define a package.

The packaging step also provides for the bonding, for example by heat-sealing, of the closing film 41 to the support 40 so as to provide a fluid-tight vacuum package housing the product P. This bonding step can be carried out at the end of or before the gas suction step from the lower tool 3.

The process comprises a further step of putting in fluid communication the at least one pressure auxiliary device 51 with at least one second packaging station 1*b* distinct from the first packaging station 1*a*. This step can be carried out simultaneously with the packaging step carried out by the station 1*a* as shown schematically in FIG. 9. The auxiliary pressure device 51 can be used, as illustrated for example in FIG. 9, for holding the film 41 at the second station 1*b* while the station 1*a* is carrying out the packaging step. Alternatively, the auxiliary pressure device 51 can be used, as illustrated for example in FIG. 13, for suctioning gas from the lower tool 3 of a packaging station. In the particular configuration in FIG. 13, the second packaging station 1*b* is carrying out the packaging step by means of the vacuum pump 50; during this step, the auxiliary device 51 is placed in fluid communication with the first station 1*a* and in particular with the lower tool 3 in order to suction gas from the inner chamber 4 of said first station 1*a* while the vacuum pump 50 is suctioning gas from the second station 1*b*. FIG. 14 illustrates a further configuration of the process which involves the performance of the packaging step by the station 1*b* and the holding step of the closing film 41 in a third station 1*c* by means of the auxiliary pressure device 51. In fact, the process provides a further step of gas suction through the second circuit 12 from a packaging station while in another station the vacuum pump 50, through the first circuit, is performing the packaging step (gas suction), from the lower and/or upper tool).

In detail, during the step of putting in fluid communication the auxiliary pressure device 51 with at least one packaging station, the latter has inside it a pressure higher than a pressure present inside the reservoir of the auxiliary pressure device 51, in order to cause a passage of gas from the packaging station towards the reservoir of the device 51 in order to: hold the closing film 41 in contact with the upper tool, to suction gas from the inner chamber 4 of the packaging station.

The packaging process may further comprise a pressure recovery step, schematically shown in FIG. 11, in which the reservoir of the auxiliary pressure device 51 is placed in fluid communication with a packaging station (in the case of FIG. 11 with the station 1*a*) at the end of a packaging step. In fact, at the end of this packaging step inside the chamber 4 there is a low pressure, lower than the atmospheric pressure measured at 20° C. If the pressure in the chamber 4 is lower than the pressure present in the reservoir of the auxiliary device 51, it is possible to connect said station (the station 1*a* in FIG. 11) with said reservoir so as to cause a transit of gas from the reservoir of the auxiliary pressure device 51 towards said packaging station 1*a* and consequently reduce the pressure present in the reservoir of the auxiliary pressure device 51. This step essentially allows to using the low pressure present inside a station at the end of a packaging step to "recharge" a low pressure in the reservoir of the device 51.

Furthermore, the "recharge" of the reservoir of the auxiliary pressure device 51 can be carried out by means of the vacuum pump as shown in FIG. 8. In this charging step, the reservoir is placed in fluid communication with the vacuum pump 50 through the third circuit 13: the pump suctions gas from the reservoir to define within it a pressure lower than the atmospheric pressure measured at 20° C. In detail, in the charging step the primary line 11*a* of the first circuit 11 is placed in fluid communication with the primary line 12*a* of the second circuit 12 through the third circuit 13.

The steps of further gas suction—for example from a second and/or third packaging station 1*b*, 1*c*—through the second circuit 12 and of "recharge" of the reservoir of the auxiliary device 51 can be carried out during the performance of the packaging step in the first station 1*a*. These steps are managed by the control unit 30 by the independent control of the plurality of valves 20 (management of the passage condition and closure condition of each valve.

In particular, the process provides for a step of reception by the control unit 30 of at least one signal representative of a parameter comprising at least one of:

- a pressure present in the inner chamber 4 of at least one packaging station 1,
- a pressure inside the pressure auxiliary device 51,
- a pressure of the first circuit 11, in particular a pressure value at at least one secondary line 11*b* of the first circuit 11,
- a pressure of the second circuit 12, in particular a pressure value at at least one secondary line 12*b* of the second circuit 12,
- a pressure at the vacuum pump 50,
- a flow rate of a gas flowing through the first circuit 11, in particular passing from at least one secondary line 11*b* of the first circuit 11,
- a flow rate of a gas flowing through the second circuit 12, in particular passing from at least one secondary line 12*b* of the second circuit 12,
- a temperature of at least one of the packaging stations 1,
- a predetermined time interval,
- a relative position of the upper and lower tools of at least one packaging station 1,
- a presence of a support supporting a product at a determined packaging station 1,
- a presence of a closing film at a determined packaging station 1,
- a predetermined actuation sequence of the plurality of control valves 20 of the first and second circuits, optionally of the third circuit, between the passage condition and closure condition,
- a condition, for example a passage or closure condition, of the plurality of control valves 20 of the first and second circuits 11, 12, optionally of the third circuit 13.

The control unit 30, according to said signal, determines a value of at least one of said parameters and defines, as a function of the determined value of at least one of said parameters, the passage or closure condition of at least one control valve 20 of the first, second or third circuit 11, 12, 13 to enable or inhibit the fluid communication.

In particular, the control unit 30 is independently controls the plurality of control valves 20 between the passage condition and closure condition for defining the first work condition. This control step comprises a step of placing the pump 50 in fluid communication with at least one first packaging station 1*a* for suctioning gas from the inner chamber 4 of said first packaging station 1*a* so as to define, within the latter, a pressure lower than the atmospheric pressure measured at 20° C. The control step, performed by the control unit 30 to define the first work condition, further comprises a step of placing the auxiliary pressure device 51 in fluid communication with a second packaging station 1*b*, said auxiliary pressure device 51 having a pressure below the atmospheric pressure measured at 20° C. In this step, the auxiliary pressure device 51 suctions gas at the inner chamber 4 of the second packaging station 1*b* so as to define a pressure lower than the atmospheric pressure measured at 20° C. Moreover in the same step, the auxiliary pressure device 51 suctions gas at a volume comprised between the closing film 41 in contact with the upper tool 2 and the latter so as to define a pressure lower than the atmospheric pressure measured at 20° C.

The control unit 30, thanks to the independent control of the plurality of control valves 20 between the passage condition and the closure condition, allows defining the second work condition. This control step, performed by the control unit 30 to define the second work condition, comprises a step of placing the pump 50 in fluid communication with one or more packaging stations 1. In this step, the vacuum pump 50 suctions gas at the inner chamber 4 of at least one of the packaging stations 1 so as to define, within the latter, a pressure lower than an atmospheric pressure measured at 20° C. Moreover in the same step, the vacuum pump 50 suctions gas at a volume comprised between the closing film 41 in contact with the upper tool 2 and the latter so as to define a pressure lower than the atmospheric pressure measured at 20° C. The control step, performed by the control unit 30 to define the second work condition, further comprises a step of placing the pump 50 in fluid communication with the reservoir of the auxiliary pressure device 51 for suctioning gas from the latter in order to define, within the reservoir, a pressure lower than an atmospheric pressure measured at 20° C.

The control unit 30 is independently controls the plurality of control valves 20 between the passage condition and closure condition for further defining the third work condition. This control step, performed by the control unit 30 to define the third work condition, comprises the step of placing the pump 50 in fluid communication with at least one first packaging station 1*a* for suctioning gas from the inner chamber 4 of said first packaging station 1*a* so as to define, within the latter, a pressure lower than the atmospheric pressure measured at 20° C. Furthermore, the control step, performed by the control unit 30 to define the third work condition, comprises the step of carrying out the recovery step, placing in fluid communication a second packaging station 1*b* with the reservoir of the auxiliary pressure device 51, wherein the reservoir has an inner pressure higher than a pressure present inside said second packaging station 1*b*.

Advantages of the Invention

The present invention allows considerable advantages to be obtained. The presence of a second circuit 12 to which the auxiliary pressure device 51 is connected allows providing a plant having a vacuum pump 50 correctly sized for the suction of gas from a packaging station. The structure of the plan 100 in fact allows performing the suction from a packaging station and at the same time performing preliminary preparation steps—such as for example the holding of the closing film and/or an initial gas suction from the inner chamber 4—on different stations in order to significantly reduce the packaging time (plant working time). The presence of the second circuit 12 and of the auxiliary pressure device 51 prevents activities (steps) performed on one or more packaging stations from negatively affecting a step of gas extraction in execution on a specific station.

The invention claimed is:

1. A plant comprising:

a plurality of packaging stations, wherein the packaging stations are distinct from each other, wherein each of the packaging stations is configured to vacuum package products, and wherein each of the packaging stations includes an upper tool and a bottom tool;

a first vacuum device and a second vacuum device, wherein one of the first and second vacuum devices is a vacuum pump and wherein one of the first and second vacuum devices is an auxiliary pressure device;

a first fluid circuit arranged to provide fluid communication between the first vacuum device and each of the top and bottom tools of each of the packaging stations;

a second fluid circuit arranged to provide fluid communication between the second vacuum device and each of the top and bottom tools of each of the packaging stations, wherein the first and second circuits are arranged in parallel with each other; and first valves in the first circuit, wherein the first valves are configured to be controlled to selectively enable or interdict the fluid communication between the first vacuum device and each of the top and bottom tools of each of the packaging stations;

second valves in the first circuit, wherein the second valves are configured to be controlled to selectively enable or interdict the fluid communication between the second vacuum device and each of the top and bottom tools of each of the packaging stations; and a third fluid circuit arranged to provide fluid communication between the first and second vacuum devices, wherein the third circuit is configured to put a first primary line of the first circuit in fluid communication with a second primary line of the second circuit.

2. The plant of claim 1, wherein the first circuit further comprises a plurality of first secondary lines, each of which is arranged to fluidly couple one of the top and bottom tools of one of the packaging stations to the first primary line of the first circuit.

3. The plant of claim 2, wherein the second circuit further comprises a plurality of second secondary lines, each of which is arranged to fluidly couple one of the top and bottom tools of one of the packaging stations to the second primary line.

4. The plant of claim 2, wherein each of the first secondary lines of the first circuit is connected in parallel to one of the second secondary lines of the second circuit.

5. The plant of claim 2, wherein:

each of the first secondary lines includes one of the first valves, and each of the second secondary lines includes one of the second valves.

6. The plant of claim 1, wherein the third circuit includes a third valve configured to enable or interdict the fluid communication between the first and second vacuum devices.

* * * * *